US008660472B2

(12) United States Patent
Kurachi et al.

(10) Patent No.: US 8,660,472 B2
(45) Date of Patent: Feb. 25, 2014

(54) DEVELOPING ROLLER, PROCESS CARTRIDGE, AND ELECTROPHOTOGRAPHIC APPARATUS

(75) Inventors: Masahiro Kurachi, Susono (JP); Hidenori Satoh, Odawara (JP); Kazutoshi Ishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/447,714

(22) Filed: Apr. 16, 2012

(65) Prior Publication Data

US 2012/0201568 A1 Aug. 9, 2012

Related U.S. Application Data

(63) Continuation of application No. PCT/JP2011/006608, filed on Nov. 28, 2011.

(30) Foreign Application Priority Data

Dec. 28, 2010 (JP) ..... 2010-292809

(51) Int. Cl.
*G03G 15/08* (2006.01)

(52) U.S. Cl.
USPC ..... 399/286

(58) Field of Classification Search
USPC ..... 399/279, 286
See application file for complete search history.

(56) References Cited

U.S. PATENT DOCUMENTS

| | | | |
|---|---|---|---|
| 6,360,069 | B1 | 3/2002 | Mimura et al. |
| 7,727,134 | B2 | 6/2010 | Nakamura et al. |
| 7,798,948 | B2 | 9/2010 | Kawamura et al. |
| 7,799,398 | B2 | 9/2010 | Nakamura et al. |
| 7,947,339 | B2 | 5/2011 | Yamauchi et al. |
| 8,182,405 | B2 | 5/2012 | Kurachi et al. |
| 2007/0111874 | A1 | 5/2007 | Sugimura et al. |
| 2009/0214272 | A1 * | 8/2009 | Furuya ..... 399/286 |

(Continued)

FOREIGN PATENT DOCUMENTS

| | | | |
|---|---|---|---|
| JP | 9-12192 | A | 1/1997 |
| JP | 11-212354 | A | 8/1999 |

(Continued)

OTHER PUBLICATIONS

PCT International Search Report of the International Searching Authority, International Application No. PCT/JP2011/006608, Mailing Date Jan. 24, 2012.

(Continued)

*Primary Examiner* — Sandra Brase

(74) *Attorney, Agent, or Firm* — Fitzpatrick, Cella, Harper and Scinto

(57) ABSTRACT

Provided is a developing roller in which: even when the roller is stored under a high-temperature, high-humidity environment over a long period of time, bleeding is suppressed; and the fusion of toner to its surface upon repeated output of images under low temperature and low humidity is suppressed. The developing roller includes: a mandrel; an elastic layer on an outer periphery of the mandrel; and a surface layer on an outer periphery of the elastic layer, in which: the surface layer contains carbon black and a polyester-polyurethane resin containing a specific structure; and the surface layer has a storage modulus E' as measured at a temperature of 0° C. and a frequency of 10 Hz of 5 MPa or more and 20 MPa or less.

12 Claims, 2 Drawing Sheets

(56) References Cited

U.S. PATENT DOCUMENTS

| | | | | |
|---|---|---|---|---|
| 2010/0080611 | A1* | 4/2010 | Kurachi et al. | 399/286 X |
| 2010/0087617 | A1 | 4/2010 | Oyanagi et al. | |
| 2010/0189473 | A1* | 7/2010 | Sugimura et al. | 399/286 |
| 2011/0091240 | A1 | 4/2011 | Anan et al. | |
| 2011/0137006 | A1* | 6/2011 | McGuire et al. | 528/85 |

FOREIGN PATENT DOCUMENTS

| | | | |
|---|---|---|---|
| JP | 2007-133228 | A | 5/2007 |
| JP | 2007-286252 | A | 11/2007 |
| JP | 2009-115952 | A | 5/2009 |
| JP | 2010-107968 | A | 5/2010 |
| JP | 2010-121105 | A | 6/2010 |
| WO | 2008/114500 | A1 | 9/2008 |

OTHER PUBLICATIONS

International Preliminary Report on Patentability, International Application No. PCT/JP2011/006608, Mailing Date Jul. 11, 2013.

* cited by examiner

DEVELOPING ROLLER, PROCESS CARTRIDGE, AND ELECTROPHOTOGRAPHIC APPARATUS

CROSS-REFERENCE TO RELATED APPLICATIONS

This application is a continuation of International Application No. PCT/JP2011/006608, filed Nov. 28, 2011, which claims the benefit of Japanese Patent Application No. 2010-292809, filed Dec. 28, 2010.

BACKGROUND OF THE INVENTION

1. Field of the Invention

The present invention relates to a developing roller, a process cartridge, and an electrophotographic apparatus.

2. Description of the Related Art

A nonmagnetic, one-component, contact developing mode has been currently attracting attention as an electrophotographic image-forming method. In the mode, toner is supplied onto the surface of a developing roller by a toner-supplying roller provided to abut the developing roller. Next, excessive toner on the surface of the developing roller is removed by a toner-regulating member so that a toner layer may be formed in a thin-film fashion on the developing roller. At the same time, toner particles are provided with a predetermined quantity of positive or negative triboelectric charge by rubbing. Further, the toner subjected to the positive or negative triboelectric charging is conveyed through the rotation of the developing roller, and then the toner is caused to adhere to an electrostatic image on the surface of an electrophotographic photosensitive member (also referred to as "photosensitive member") placed to contact the developing roller so that the image may be developed. Such developing roller generally has such a construction that an elastic layer is provided for the periphery of a conductive mandrel and a surface layer is provided for its outer periphery as required.

By the way, an electrophotographic apparatus has been requested to stably provide high-quality electrophotographic images under a wide variety of environments. However, it is difficult for the apparatus to stably output high-quality electrophotographic images under each of a high-temperature, high-humidity environment (having, for example, a temperature of 40° C. and a humidity of 95% RH) and a low-temperature, low-humidity environment (having, for example, a temperature of 0° C. and a humidity of 10% RH).

Specifically, when a developing roller is mounted on a process cartridge or an electrophotographic apparatus, the developing roller may be stored under a high-temperature, high-humidity environment over a long period of time. In such case, a small amount of an unreacted product present in the elastic layer or surface layer of the developing roller has sometimes deposited (bled) onto the outermost surface of the developing roller. This is probably because of the following reason. Under high temperature and high humidity, the molecular mobility of a polymer for forming the elastic layer or surface layer of the developing roller is raised so that the unreacted product may be apt to migrate toward the surface. When the developing roller to the surface of which such unreacted product has bled is used in the formation of an electrophotographic image, unevenness may occur in the electrophotographic image.

On the other hand, under a low-temperature, low-humidity environment, a stress to be applied to toner may become excessively strong owing to a relative increase in the surface hardness of the developing roller. As a result, the toner has fused to the surface of the developing roller in some cases.

Japanese Patent Application Laid-Open No. H09-12192 describes a method involving using an ester polyol derived from 2,4-diethyl-1,5-pentanediol as a urethane raw material for the purpose of suppressing the environment dependence of a rubber member for electrophotography.

In addition, Japanese Patent Application Laid-Open No. H11-212354 discloses, for the purpose of suppressing toner fusion (melt-adhesion) under a low-temperature, low-humidity environment, a construction having a mandrel and a urethane elastic layer on its outer periphery, and having, on the peripheral surface of the layer, a surface layer containing a polyurethane having a polysiloxane skeleton in a molecule thereof.

SUMMARY OF THE INVENTION

According to an investigation conducted by the inventors of the present invention, however, in the rubber member for electrophotography described in Japanese Patent Application Laid-Open No. H09-12192 described above, a stress to be applied to toner is strong owing to a high hardness of the rubber member, and hence the toner has fused to the surface layer of a developing roller in some cases. In addition, when the developing roller described in Japanese Patent Application Laid-Open No. H11-212354 is stored under a high-temperature, high-humidity environment over a long period of time, an unreacted product has bled in some cases.

The present invention is directed to providing the following developing roller: Even when the roller is stored under a high-temperature, high-humidity environment over a long period of time, bleeding is suppressed. In addition, the fusion of toner to its surface upon repeated output of images under low temperature and low humidity is suppressed.

The present invention is directed to providing a process cartridge and an electrophotographic apparatus conducive to the formation of high-quality electrophotographic images.

In view of the problems, the inventors of the present invention have conducted investigations on the suppression of bleeding at the time of long-term storage under a high-temperature, high-humidity environment and the alleviation of the fusion of toner to the surface under a low-temperature, low-humidity environment.

As a result, the inventors have found that the afore-mentioned developing roller can be obtainable by the selection of the structures of a soft segment and a hard segment for forming a polyurethane resin to be used in the surface layer of a developing roller and by the optimization of the storage modulus (E') of the surface layer.

According to one aspect of the present invention, there is provided A developing roller comprising:

a mandrel;

an elastic layer provided on an outer periphery of the mandrel; and a surface layer provided on an outer periphery of the elastic layer, wherein:

the surface layer comprises carbon black, and a polyester-polyurethane resin, and wherein the polyester-polyurethane resin comprises the following structures A and B;

A: at least one structure selected from the group consisting of the structures represented by the following chemical formulae (a) and (b); and B: at least one structure selected from the group consisting of structures represented by the following chemical formulae (c) to (g):

(a)

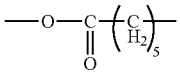

(b)

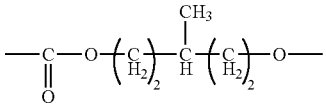

(c)

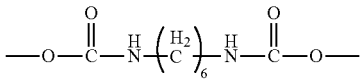

(d)

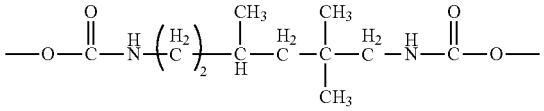

(e)

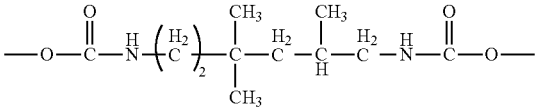

(f)

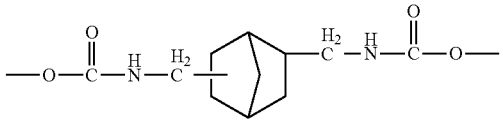

(g)

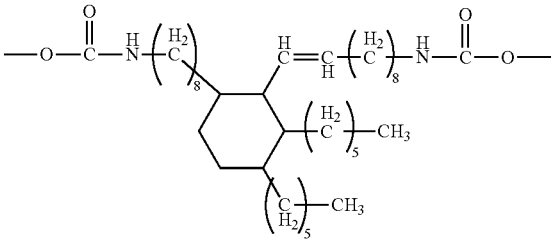

and the surface layer has a storage modulus E' of 5 MPa or more and 20 MPa or less, the storage modulus being measured at a temperature of 0° C. and a frequency of 10 Hz.

According to another aspect of the present invention, there is provided a process cartridge, including: a developing roller; a toner-regulating member; and a toner container, and being so constituted as to be detachably mountable to the main body of an electrophotographic apparatus, in which the developing roller includes the developing roller described above.

According to further aspect of the present invention, there is provided an electrophotographic apparatus, including: an electrophotographic photosensitive member; and a developing roller placed to abut the electrophotographic photosensitive member, in which the developing roller includes the developing roller described above.

According to the present invention, even when the developing roller is stored under a high-temperature, high-humidity environment over a long period of time, image unevenness resulting from a bleeding product can be suppressed. In addition, an image drawback resulting from toner fusion upon repeated output of images under low temperature and low humidity can be suppressed. Further, an electrophotographic apparatus and a process cartridge conducive to the formation of high-quality electrophotographic images can be obtained.

DESCRIPTION OF THE EMBODIMENTS

Figure 1:
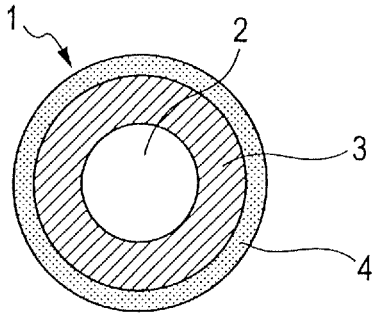
FIG. 1 is a sectional view of a developing roller according to the present invention in a direction perpendicular to its axis.

FIG. 1 is a sectional view of a developing roller according to the present invention viewed from a direction perpendicular to the axis of the developing roller. A developing roller 1 has a columnar or hollow cylindrical, conductive mandrel 2, at least one elastic layer 3 formed on the periphery of the mandrel, and a surface layer 4 formed on the outer periphery of the elastic layer.

<Surface Layer>

The surface layer of the developing roller contains carbon black and a polyester-polyurethane resin.

Here, the polyester-polyurethane resin has at least one of the structures represented by the following chemical formulae (a) and (b), and at least one unit selected from units represented by the following chemical formulae (c), (d), (e), (f), and (g).

(a)

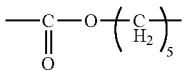

(b)

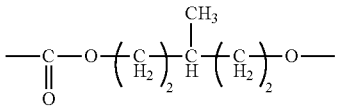

(c)

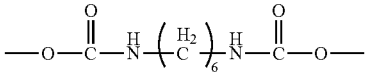

(d)

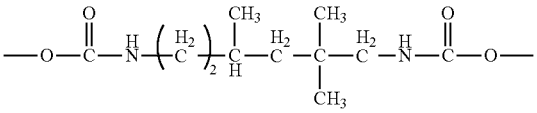

(e)

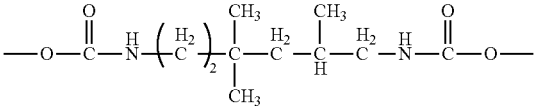

-continued (f)

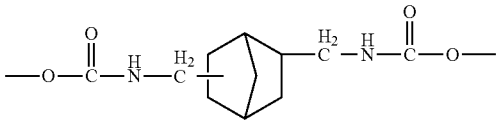

(g)

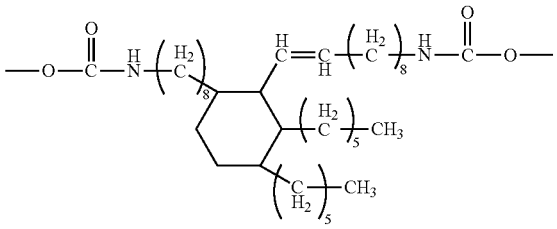

A polyurethane resin is not a name referring to a polymer having single composition but a generic name for polymers each containing a urethane bond, and is formed of a soft segment such as an ester group or an ether group and a hard segment such as a urethane bond, an allophanate bond, or a biuret bond.

The polyurethane resins are generally classified into, for example, an ester urethane resin, an ether urethane resin, a carbonate urethane resin, an acryl urethane resin, and an olefin urethane resin depending on a chemical bond species for forming the soft segment.

In addition, the polyurethane resin can express various characteristics due to an elaborately controlled, minutely-aggregated structure (morphology) like the form of an inter-crosslink distance.

The polyester-polyurethane resin in the present invention has such a structure that the soft segment in the polymer contains an ester group.

In addition, in the present invention, the chemical formulae (a) and (b) each represent a structure containing an ester group for forming a soft segment A in the polyester-polyurethane resin.

In addition, the chemical formulae (c), (d), (e), (f), and (g) each represent a structure containing a urethane group for forming a hard segment B in the polyurethane resin.

Chemical structures which the soft segment and the hard segment have largely affect the mechanical characteristics of the polyurethane resin and the formation of a morphology.

First, an influence of crystallinity is described. Specifically, when the crystallinity of one of the soft segment and the hard segment is high, the crystallinity contributes to an increase in the hardness of the urethane resin. On the other hand, it has been known that the morphology is apt to enlarge and the distribution of inter-crosslink distances in the polyurethane resin is apt to broaden. A difference in polarity between the soft segment and the hard segment also largely affects the formation of the morphology. This is because of the following reason. As the soft segment has relatively low polarity as compared with that of the hard segment having a urethane group having high polarity, the polyurethane resin forms a microphase-separated structure, and when the difference in polarity between both the segments is large, the morphology is apt to enlarge. In this case, the hard segment corresponds to a crosslinking point and the soft segment corresponds to a main chain polymer between crosslinking points.

An unreacted product in the elastic layer or the surface layer may selectively migrate from a portion having a larger morphology, that is, a portion having a larger distance between crosslinking points to the surface. Accordingly, the densification of the morphology related to the distribution of the distances between crosslinking points is important for effective suppression of the bleeding.

On the other hand, a simple reduction in distance between crosslinking points leads to an increase in the hardness of the polyester-polyurethane resin. The developing roller having a surface layer containing such resin has a high surface hardness, which may be responsible for the induction of the fusion of toner to its surface. Therefore, in order that the objects of the present invention may be achieved, the control of both the morphology and the mechanical characteristics by the selection of a chemical unit at a molecular level is needed in the polyester-polyurethane resin.

In consideration of the technical discussion, the inventors of the present invention have conducted extensive investigations. As a result, the inventors have found that it is effective for the surface layer of the developing roller in the present invention to contain a polyester-polyurethane resin containing at least one structure of the units represented by the chemical formulae (a) and (b) as the soft segment A, and containing at least one structure selected from the structures represented by the chemical formulae (c) to (g) as the hard segment B.

The number of carbon atoms of an aliphatic moiety in a polyester has been known to exert the so-called odd-even effect that affects the basic physical properties of the polymer. The number of carbon atoms of the main chain of an aliphatic moiety in each of both the structures represented by the chemical formula (a) and the chemical formula (b) described above is odd. Accordingly, the structures each have lower structural regularity than that of an ester polyol having a main chain with an even number of carbon atoms and hence each show lower crystallinity. Therefore, the structures are preferred from the viewpoint of the suppression of the bleeding by the densification of the morphology.

Further, the selection of the number of carbon atoms of a main chain is also of importance. When the number of carbon atoms of the main chain is excessively small, the main chain is apt to be molecularly rigid, thereby making it difficult to control mechanical characteristics such as a storage modulus (E'). On the other hand, when the number of carbon atoms of the main chain is excessively large, crystallinity is apt to be raised and an inter-crosslink distance is apt to enlarge. As a result, an unreacted content is apt to migrate through a portion having a large distance between crosslinking points. That is, a low-molecular weight component is apt to bleed.

A factor such as the presence or absence of a side chain such as a methyl group also affects the crystallinity of the soft segment and the bleeding characteristic of the surface layer. The presence of an alkyl group such as a methyl group at a side chain reduces the structural regularity and hence can suppress the crystallinity. Accordingly, the densification of the morphology is facilitated. Further, the presence of a methyl group or the like in the polymer corresponding to an inter-crosslink distance portion results in the formation of steric hindrance, thereby enabling effective suppression of the bleeding. From the foregoing viewpoints, the polyester-polyurethane resin containing the structure represented by the chemical formula (b) as the soft segment A is particularly preferred in order that an effect of the present invention may be expressed at a high level.

In addition, the structure represented by the chemical formula (b) strongly affects the polarity of a resin material by virtue of the presence of an ester group. In particular, a resin material having such unit shows high hydrophilicity (polarity) as compared with that of a soft segment species such as a polyolefin, a polyether, or a polycarbonate. Therefore, the difference in polarity with the hard segment can be reduced and hence the densification of the morphology can be facilitated.

Next, any one of the structures represented by the chemical formulae (c), (d), (e), (f), and (g) is incorporated into the hard segment B in the polyester-polyurethane resin in the present invention.

Hard segments in polyurethane resins are generally classified into two types, i.e., an aromatic hard segment and an aliphatic hard segment.

The aromatic hard segment is molecularly rigid and excellent in mechanical characteristics because the segment has a benzene ring in its skeleton. In addition, the segment has strong crystallinity and high polarity because the segment has the benzene ring in the skeleton.

Although the aliphatic hard segment is inferior in mechanical characteristics to the aromatic hard segment, the former segment has lower crystallinity and relatively lower polarity.

In addition, from the viewpoints of the suppression of excessive increases in mechanical characteristics, and the densification of the morphology by the control of the crystallinity and the reduction of the difference in polarity with the soft segment, the hard segment for forming the polyester-polyurethane resin according to the present invention was designed so as to contain a structure belonging to the aliphatic groups. The advantageous effect of the present invention can be achieved at an additionally high level by incorporating, as a hard segment, at least one selected from the group consisting of the structures represented by the chemical formulae (c), (d), and (e) out of the structures represented by the chemical formulae (c) to (g).

As described above, the inventors assume that the polyester-polyurethane resin according to the present invention has exerted the following effects (1) to (3) and has contributed to the suppression of each of the bleeding and the toner fusion as a result of the combination of the soft segment A having a specific structure and the hard segment B having a specific structure:

(1) the densification of the morphology and a reduction in the amount of the unreacted product by the reduction of the difference in intramolecular polarity between the soft segment A and the hard segment B;

(2) the densification of the morphology by the control of the crystallinity of each of both the soft segment A and the hard segment B; and (3) the approximation of the rigidities of the soft segment A and the hard segment B at a molecular level, in other words, the alleviation of the stress to be applied to the toner by a reduction in ultramicroscopic hardness unevenness.

The composition of each of the soft segment A and the hard segment B in the polyester-polyurethane resin according to the present invention can be identified by an infrared spectroscopy (IR) method or by employing a pyrolysis gas chromatography (Pyr-GC) method after the hydrolysis of a resin material.

In addition, the surface layer according to the present invention has a storage modulus (E') measured at a measuring temperature of 0° C. and a frequency of 10 Hz in the range of 5 MPa or more and 20 MPa or less.

Here, the storage modulus (E') refers to an ability to retain a stress accumulated in a substance such as a rubber or a resin, and is an indicator that closely correlates with the hardness of the substance. The value is generally measured with a dynamic viscoelasticity-measuring apparatus (dynamic mechanical analysis). The storage modulus (E') in the surface layer falls within an extremely low range as compared with that of a general urethane material. When the storage modulus (E') of the surface layer falls within the range, even when image output is repeatedly performed in a low-temperature environment (0° C.), toner deterioration is suppressed. Accordingly, such storage modulus contributes to the expression of extremely excellent toner fusion resistance.

The value for the storage modulus (E') of the surface layer, which is controlled by the distance between crosslinking points of the polyester-polyurethane resin, the molecular rigidity of each of the soft segment and the hard segment, and the kinds and blending amounts of, for example, the carbon black and a filler, is mainly dominated by the distance between crosslinking points.

Further, a flexible polyester-polyurethane resin having a large distance between crosslinking points generally shows such a tendency that the amount of an unreacted component increases. This is because the amount of a functional group that contributes to crosslinking such as a hydroxyl group or an isocyanate group reduces as the molecular weight of a raw material for the polyester-polyurethane resin increases. That is also because the mobilities of raw materials for the polyester-polyurethane resin containing an isocyanate group as a reaction group at the time of a crosslinking reaction for polyurethane production and a hydroxyl group as a group to be reacted, and the frequency at which the raw materials contact each other reduce, and hence the unreacted product is apt to remain stochastically.

As described above, the suppression of the bleeding and the suppression of the toner fusion in the developing roller are apt to fall into a trade-off relationship, and hence it may be difficult to achieve compatibility between the suppressions. Therefore, to satisfy the following two points through strict selection of the soft segment and the hard segment for forming the polyester-polyurethane resin is the most important requirement for expressing the effect of the present invention:

(1) the densification of the morphology of the polyester-polyurethane resin; and (2) the control of the storage modulus (E') of the surface layer under a low-temperature (low-humidity) environment.

In order that the two points may be satisfied, the combination of the units for forming the polyester-polyurethane resin in the present invention is strictly controlled. As a result, the resin shows the following features. While the resin has a relatively large distance between crosslinking points and is flexible, the distribution of the distances is sharp.

Further, when the difference in polarity between the soft segment and the hard segment is controlled to the extent possible, the resin shows the following feature. The frequency at which the raw materials for the polyester-polyurethane resin containing an isocyanate group and a hydroxyl group as a group to be reacted contact each other at the time of the crosslinking reaction increases, and hence the unreacted product hardly remains. Therefore, the developing roller according to the present invention can achieve an extremely high level of suppression of each of the bleeding and the toner fusion by the following two reasons:

(1) although the resin is extremely flexible, the distribution of the inter-crosslink distances is uniform and the amount of a portion having a large inter-crosslink distance is small; and (2) the amount of the unreacted product in the surface layer is small.

In addition, the value for the storage modulus (E') may vary to a large extent depending on the measuring temperature and the measuring frequency. Therefore, the measuring temperature in the present invention was set to 0° C. identical to the temperature at the time of an evaluation for toner fusion in a low-temperature environment to be described later. In addition, the excitation frequency of vibration to be generated at the time of actual driving varies depending on, for example, the rotational speed of the developing roller, a difference in circumferential speed with a photosensitive member which the roller contacts, and the construction of the surface layer. Therefore, the storage modulus (E') in the present invention was defined by a value at 10 Hz close to the average of excitation frequencies in an actual machine.

In other words, setting the storage modulus (E') of the surface layer measured under the conditions of a measuring temperature of 0° C. and a frequency of 10 Hz to 5 MPa or more can suppress an increase in the inter-crosslink distance of the polyester-polyurethane resin and hence can prevent the bleeding. Meanwhile, setting the storage modulus (E') to 20 MPa or less can reduce the stress to be applied to the toner in the repeated image output and hence can suppress the fusion of the toner onto the surface layer of the developing roller. On the other hand, when the storage modulus (E') of the surface layer is less than 5 MPa, the inter-crosslink distance of the polyester-polyurethane resin excessively increases and hence the bleeding is apt to occur in some cases. In addition, when the storage modulus is more than 20 MPa, the stress to be applied to the toner at the time of the repeated image output is strong and hence the fusion of the toner onto the surface layer of the developing roller occurs in some cases.

Further, the surface layer contains the carbon black. The carbon black contributes to the optimization of the mechanical characteristics and conductivity of the surface layer, and the suppression of the bleeding of the unreacted product. An approach such as an increase in inter-crosslink distance or the loading of a reinforcing filler such as the carbon black is generally adopted for imparting a bleeding-suppressing effect to the polyester-polyurethane resin. The increase in inter-crosslink distance leads to the suppression of bleeding from the inside of each of the elastic layer and the surface layer. This is because the network structure of the polyester-polyurethane resin becomes dense and hence the migration of the unreacted product from the inside of each of the elastic layer and the surface layer is suppressed. However, an excessive increase in inter-crosslink distance involves an increase in glass transition temperature. Accordingly, the polyester-polyurethane resin shows a remarkable increase in its hardness in a temperature region where an electrophotographic apparatus is used, and hence the stress to be applied to the toner abruptly increases. As a result, the toner fusion may be remarkably exacerbated. In addition, the carbon black exists while being dispersed in the surface layer, thereby exerting a lengthening effect on a path along which a bleeding product adsorbs or migrates to the surface of the carbon black upon its migration toward the surface. Accordingly, the carbon black serves to inhibit the migration of the unreacted product from the inside of each of the elastic layer and the surface layer to the outermost surface of the developing roller, thereby leading to the bleeding-suppressing effect. Therefore, in the present invention, the carbon black needs to be incorporated as an essential component from the viewpoint of the achievement of compatibility between the suppression of the bleeding and the suppression of the stress to be applied to the toner.

The content of the carbon black in the surface layer falls within the range of preferably 1 to 60 parts by mass, more preferably 15 to 30 parts by mass with respect to 100 parts by mass of the polyester-polyurethane resin component. When the content of the carbon black is 1 part by mass or more, moderate conductivity of the surface layer is obtained. In addition, reductions in the mechanical characteristics of the surface layer and the suppression of the bleeding can be achieved. Meanwhile, when the content is 60 parts by mass or less, the dispersion uniformity of the carbon black for the polyester-polyurethane resin component is obtained and hence the moderate conductivity is obtained. In addition, an excessive increase in hardness is suppressed and hence the toner fusion can be prevented.

The average primary particle diameter of the carbon black is preferably set to 15 to 50 nm in consideration of the maintenance of the strength of the polyester-polyurethane resin and the exertion of proper conductivity. In addition, the DBP absorption of the carbon black is preferably set to, for example, 50 to 300 ml/100 g by the same reasons. The DBP absorption is more preferably 60 to 180 ml/100 g. Setting the DBP absorption that correlates with the secondary particle diameter of the carbon black within the range can achieve compatibility between dispersibility and a shielding effect. Carbon black produced by, for example, a channel method or a furnace method can be suitably used as such carbon black. Further, two or more kinds of carbon black may be blended in accordance with required physical properties.

In addition, the surface layer according to the present invention preferably contains an organometallic catalyst as a crosslinking aid. The incorporation of the organometallic catalyst reduces the amount of the unreacted product in the surface layer and hence can suppress image unevenness due to its bleeding. Although the kind of the organometallic catalyst is not particularly limited in the present invention, examples thereof include the following: dibutyltin dilaurate, dibutyltin diacetate, dibutyltin oxide, dibutyltin mercaptide, dioctyltin mercaptide, dibutyltin thiocarboxylate, dioctyltin thiocarboxylate, maleic acid dibutyltin (dibutyltin maleate), octenoic acid tin, bismuth 2-ethyl hexanoate, bismuth neodecanoate, bismuth oxycarbonate, titanium-ethyl acetoacetate chelate, zirconium-ethyl acetoacetate chelate, zirconium acetylacetone chelate, stannous octoate, phenyl mercury, silver propionate, mercury neodecanoate, and zinc neodecanoate. Of those organometallic catalysts, a Bi- or Ti-based organometallic catalyst is particularly preferred from the viewpoints of the suppression of environmental pollution and the control of a crosslinking form. In addition, the content of the organometallic catalyst in the surface layer falls within the range of preferably 0.05 to 2.0 parts by mass, more preferably 0.25 to 1.0 part by mass with respect to 100 parts by mass of the polyester-polyurethane resin component. When the content of the organometallic catalyst is 0.05 part by mass or more, sufficient reactivity is obtained, the amount of the unreacted product reduces, and the reductions of the mechanical characteristics and the bleeding can be suppressed. Meanwhile, when the content is 2.0 parts by mass or less, the bleeding of the organometallic catalyst itself is prevented and hence the occurrence of image unevenness can be suppressed.

In order that moderate surface roughness may be imparted to the surface of the developing roller, the surface layer may contain spherical fine particles for forming irregular shapes on the surface. When the surface layer contains the spherical fine particles, the surface roughness of the surface of the developing roller can be easily uniformized. At the same time, even when the surface layer 4 wears, the fluctuation of the surface roughness is reduced and hence its surface state can be kept constant. The spherical fine particles preferably have a volume-average particle diameter of 5 to 30 μm. A laser diffraction-type particle size distribution-measuring apparatus (trade name: Model LS-230; manufactured by Beckman Coulter, Inc.) mounted with a liquid module can be used for the measurement of the volume-average particle diameter of the fine particles. The measurement is performed as described below. A trace amount of a surfactant is added to about 10 cc of water. About 10 mg of the fine particles are added to the mixture and then dispersed with an ultrasonic dispersing machine for 10 minutes. After that, the resultant is subjected to the measurement under the conditions of a measuring time of 90 seconds and a number of times of measurement of one. The value measured by the measurement method can be adopted as a value for the volume-average particle diameter. The content of the spherical fine particles is preferably 1 to 100 parts by mass with respect to 100 parts by mass of the polyester-polyurethane resin component resin of the surface layer.

A urethane resin, a polyester resin, a polyether resin, an acrylic resin, a polycarbonate resin, or the like can be used as a material for the spherical fine particles. Those spherical fine particles can be produced by, for example, suspension polymerization or a dispersion polymerization method.

In addition to the components, various additives such as a filler, an extender, a vulcanizer, a vulcanization aid, an antioxidant, an age resister, and a processing aid can each be incorporated into the surface layer as required to such an extent that the functions of the components are not impaired.

In addition, the thickness of the surface layer is preferably 1 to 100 μm, more preferably 2 to 30 μm. When the thickness of the surface layer is 1 μm or more, the bleeding of an exuding substance which a layer below the surface layer contains can be suppressed. When the thickness of the surface layer is 100 μm or less, an increase in the hardness of the developing roller is suppressed and hence the toner fusion can be suppressed. It should be noted that the thickness of the formed surface layer is measured as described below. The thicknesses of the surface layer are measured with a digital microscope (VH-2450: KEYENCE CORPORATION) at three sites arranged at an equal interval in the longitudinal direction of the developing roller from an end portion thereof and three sites arranged at an equal interval in its circumferential direction, i.e., a total of nine sites, and the arithmetic average of the resultant values is defined as the thickness of the surface layer.

<Method of Forming Surface Layer>

As described above, in the surface layer, the morphology and mechanical characteristics of the polyester-polyurethane resin need to be properly controlled through the control of the difference in polarity between the soft segment and the hard segment, and the difference in molecular rigidity therebetween. This is because the morphology of the polyester-polyurethane resin strongly affects the storage modulus that correlates with the bleeding resistance and toner fusion resistance of the surface layer, and these characteristics are in a trade-off relationship. In view of the foregoing, the selection of a polyol and an isocyanate compound as raw materials is important for the formation of such surface layer.

The surface layer having the construction can be formed by: forming, on the peripheral surface of the elastic layer, a coating film of a coating fluid for forming the surface layer containing a polyester-polyurethane resin raw material mixture containing a polyester polyol, an isocyanate compound, and carbon black described below; and curing the coating film.

<Polyester Polyol>

The polyester polyol according to the (A) contains at least one of the units represented by the formulae (a) and (b). A polyester polyol obtained by a direct esterification reaction or a ring-opening polymerization reaction can be used as such polyester polyol. Alternatively, a polyurethane polyol prepolymer obtained by elongating the chains of the polyester polyol and an isocyanate compound can be suitably used. The polyurethane polyol prepolymer in this case is characterized by containing, as a skeleton, at least one selected from the units represented by the formulae (c) to (g).

The polyester polyol synthesized by the direct esterification reaction is obtained by subjecting a polybasic acid and a polyhydric alcohol as raw materials to dehydration condensation. Examples of the polybasic acid include adipic acid, isophtalic acid, tetrachlorophthalic anhydride, HET acid, tetrabromophtalic anhydride, phtalic anhydride, telephtalic acid, tetrahydrophtalic anhydride, hexahydrophthalic anhydride, succinic acid, sebacic acid, fumalic acid, trimellitic acid, dimeric acid, maleic anhydride, 1,12-dodecanedioic acid, 1,2-cyclohexane dicarboxylic acid, 1,3-cyclohexane dicarboxylic acid, 1,4-cyclohexane dicarboxylic acid, and 5-sodium sulfoisophtalic acid. Of those, adipic acid and sebacic acid, which are aliphatic dibasic acids, are particularly preferred in view of controlling the morphology and the storage modulus (E') by the suppression of excessive increase in crystallinity and of molecular rigidity.

In addition, examples of the polyhydric alcohol as a common raw material of a polyester polyol include the following: 1,4-butanediol, 1,3-butanediol, 2,3-butanediol, ethyleneglycol, diethyleneglycol, dipropyleneglycol, triethyleneglycol, 1,5-pentanediol, 1,6-hexanediol, neopentylglycol, bisphenol A, glycerin, pentaerythritol, trimethyrol propane, trimethyrol ethane, 1,4-cyclohexane dimethanol, 2,2,4-trimethyl-1,3-pentanediol, 2-butyl-2-ethyl-1,3-propanediol, hydroxypivaloylhydroxypivalate, 3-methyl-1,5-pentanediol, 2-methyl-1,8-octanediol, 1,9-nonanediol, 2-methyl-1,3-propanediol, and 2,4-diethyl-1,5-pentanediol.

The polyester polyol is not particularly limited as long as the polyester polyol contains at least one structure out of the structures represented by the chemical formulae (a) and (b). However, a polycaprolactone polyol obtained by the ring-opening polymerization reaction of ϵ-caprolactone as a raw material or a polyester polyol using 3-methyl-1,5-pentanediol as a raw material is preferably used.

Of the polycaprolactone polyols, a non-crystalline polycaprolactone polyol or a polycaprolactone polyol of a type showing such property as a low melting point is particularly preferred from the viewpoints of the control of the aggregated structure by the suppression of crystallinity and the control of the storage modulus (E'). In addition, a polyester polyol using 3-methyl-1,5-pentanediol as a raw material is particularly preferred. 3-Methyl-1,5-pentanediol shows a specifically low melting point (−50° C.) as compared with the melting point (−10° C. to 200° C.) of a general polyhydric alcohol. Therefore, a degree of crystallinity in the soft segment having an ester group in the urethane resin can be easily controlled. Accordingly, such polyester polyol is particularly preferred from the viewpoint of the suppression of the bleeding by the control of the aggregated structure of the polyurethane resin. The polyester polyol is also preferred from the viewpoint of the suppression of the bleeding by steric hindrance because the polyester polyol has a methyl group in its chemical structure.

In addition, the polyester polyol has a number-average molecular weight (Mn) in the range of preferably 500≤Mn≤4,000, particularly preferably 1,000≤Mn≤3,000. When the Mn is 500 or more, an increase in the storage modulus (E') of the surface layer is suppressed and hence a reducing effect is exerted on the stress to be applied to the toner in repeated image output under low temperature and low humidity. In addition, when the Mn is 4,000 or less, an increase in the inter-crosslink distance of the polyester-polyurethane resin is suppressed and hence bleeding under high-temperature, high-humidity conditions can be suppressed.

<Isocyanate Compound>

The isocyanate compound according to the (B) is characterized by containing, after the crosslinking reaction with the polyester polyol, at least one structure selected from the group consisting of the structures represented by the chemical formulae (c), (d), (e), (f), and (g) as a skeleton. The following can be given as examples of the isocyanate compound in the present invention: hexamethylene diisocyanate (HDI), 2,2,4- or 2,4,4-trimethylhexamethylene diisocyanate (TM-HDI), norbornene diisocyanate (NBDI), a dimer acid diisocyanate (DDI), copolymerized products thereof, and block bodies and mixtures thereof.

Of the examples, a prepolymer-type isocyanate compound containing at least one of the units represented by the chemical formulae (a) and (b) in a denatured portion (soft segment portion) is particularly preferred because its compatibility with the polyester polyol and its physical properties can be easily adjusted. The same raw material as that used in the polyester polyol can be suitably used as a raw material for forming the denatured portion containing a unit represented by the chemical formula (a) or (b). The prepolymer-type isocyanate compound preferably has a number-average molecular weight (Mn) in the range of $6{,}000 \leq Mn \leq 12{,}000$, though the optimum Mn varies depending on the kind or Mn of the polyol of the denatured portion. When the Mn is 6,000 or more, an increase in inter-crosslink distance, in other words, the increase of the storage modulus (E') is suppressed, and hence the toner fusion under low temperature and low humidity can be suppressed. Meanwhile, when the Mn is 12,000 or less, an excessive reduction in inter-crosslink distance is suppressed and hence image unevenness due to an increase in the amount of a bleeding product can be suppressed. Further, when the number-average molecular weight of the polyol to be used in the denatured portion of the prepolymer-type isocyanate compound is defined as an MnBI and the number-average molecular weight of the polyol as the main agent is defined as an MnP, a ratio of the MnP to the MnBI particularly preferably falls within the range of $0.5 \leq MnP/MnBI \leq 2$. As described above, in the polyurethane resin, the soft segment portion corresponds to an inter-crosslink distance. Accordingly, when the ratio is set to fall within the range, the morphology is elaborately controlled and hence the bleeding can be suppressed at a high level.

The isocyanate compound is particularly preferably blended so that an isocyanate index may fall within the range of 1.0 to 1.5 with respect to the polyester polyol. When the compound is blended so that the index may fall within the range, bleeding due to an increase in the amount of the unreacted product and an excessive increase of the hardness can be suppressed. It should be noted that the term "isocyanate index" refers to a ratio of the number of moles of an isocyanate group in the isocyanate compound to the number of moles of a hydroxyl group in the polyester polyol component ([NCO]/[OH]).

<Carbon Black>

Oxidized carbon black provided with a surface functional group by an oxidation treatment is preferably used as the carbon black in order that the carbon black may be favorably dispersed in the coating fluid. The oxidized carbon black preferably has a pH value of 5.0 or less. As the oxidized carbon black has a polar group on its surface, its affinity for the resin component for forming the surface layer is improved. Accordingly, even when the carbon black is used to such an extent that sufficient conductivity can be imparted, the carbon black can be uniformly dispersed. As a result, aggregation over time can be suppressed and the occurrence of an image failure such as a ghost or of a leak can be suppressed.

A solvent that can be used in the coating fluid for forming the surface layer containing the polyester polyol, the isocyanate compound, and the carbon black is, for example, methyl ethyl ketone, methyl isobutyl ketone, xylene, or butyl acetate. In addition, a coating method such as spraying, dipping, or roll coating can be employed as a method of forming the coating film of the coating fluid on the elastic layer. In addition, the surface layer can be formed by curing the coating film formed on the elastic layer through the removal of the solvent as a result of its drying. Each of heating and electron beam irradiation is available as a method of curing the coating film.

Figure 2:
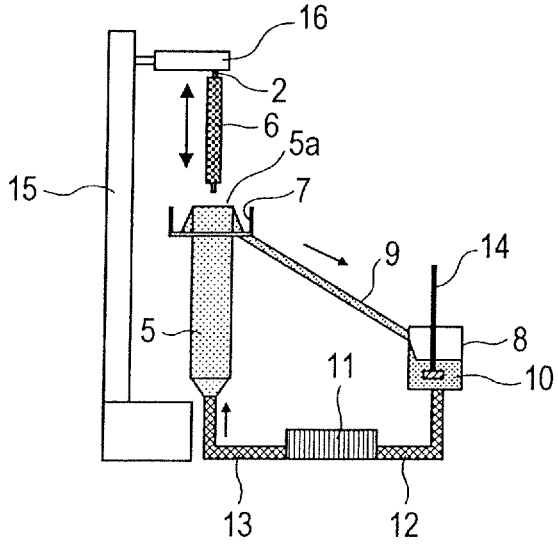
FIG. 2 is an explanatory diagram of a liquid circulation-type dip coating apparatus to be used for the formation of the surface layer of the developing roller according to the present invention.

When dip coating is employed for the formation of the coating film, a dip coating apparatus having a mechanism for circulating the coating fluid illustrated in FIG. 2 is preferably used. The coating apparatus illustrated in FIG. 2 has a dipping tank 5. The dipping tank 5 has a cylindrical shape provided with an inner diameter slightly larger than the outer diameter of a roller 6 on which the elastic layer 3 has been formed and a depth longer than the length of the roller 6 in its axial direction, and is placed with its axial direction directed toward a vertical direction.

The outer periphery of its upper end portion is provided with a cyclic liquid-receiving portion 7, and the liquid-receiving portion 7 is connected to a stirring tank 8 by a tube 9 connected to its bottom surface. Meanwhile, the bottom portion of the dipping tank 5 is connected to a pump 11 for circulating a coating fluid 10 for forming the surface layer through a tube 13. In addition, the pump 11 and the stirring tank 8 are connected to each other by a connecting tube 12. The stirring tank 8 is provided with a stirring blade 14 for stirring the coating fluid 10 for forming the surface layer stored therein. The coating apparatus is provided with a hoisting and lowering apparatus 15 for hoisting and lowering a hoisting and lowering plate 16 in the axial direction of the dipping tank 5 in the upper portion of the dipping tank 5.

In addition, the roller 6 suspended from the hoisting and lowering plate 16 is adapted to be capable of entering, and retreating from, the dipping tank 5. In order that the surface layer 4 may be formed on the elastic layer 3 with such coating apparatus, the pump 11 is driven so that the coating fluid 10 for forming the surface layer stored in the stirring tank 8 may be supplied to the dipping tank 5 through the tubes 12 and 13. The hoisting and lowering apparatus 15 is driven to lower the hoisting and lowering plate 16 so that the roller 6 may be caused to enter the dipping tank 5 filled with the coating fluid 10 for forming the surface layer. The coating fluid 10 for forming the surface layer that has spilled from an upper end 5*a* of the dipping tank as a result of the entry of the roller 6 is received by the liquid-receiving portion 7, and is then returned to the stirring tank 8 through the tube 9. After that, the hoisting and lowering apparatus is driven to hoist the hoisting and lowering plate so that the roller may be retreated from the dipping tank 5 at a predetermined speed and the coating film may be formed on the elastic layer 3.

During the foregoing, the stirring blade 14 is rotated in the stirring tank 8 to stir the application liquid so that the sedimentation of its contents may be suppressed and the uniformity of the application liquid may be maintained. The roller on which the coating film has been formed is removed from the hoisting and lowering plate 16, and then the coating film is dried so as to cure. Thus, the surface layer 4 is molded.

<Mandrel>

The mandrel to be used in the developing roller of the present invention has only to have such a strength that the mandrel can support the at least one elastic layer 3 as an upper layer and convey toner to a photosensitive member, and such conductivity that the mandrel can serve as an electrode capable of moving the charged toner to the photosensitive member. A material for the mandrel is, for example, a metal or an alloy such as aluminum, stainless steel, a synthetic resin having conductivity, iron, or a copper alloy. Further, any such material may be subjected to an oxidation treatment or to a plating treatment with, for example, chromium or nickel. With regard to the kind of the plating, each of electroplating and electroless plating can be employed. However, the electroless plating out of the kinds is preferred from the viewpoint of dimensional stability. Nickel plating (Kanigen plating), copper plating, gold plating, and plating of various other alloys can be given as examples of the kind of the electroless plating to be employed here. A plating thickness is desirably 0.05 μm or more, and the plating thickness is preferably 0.1 to 30 μm in consideration of a balance between working efficiency and a rust-preventing ability. A rod-like body or a pipe-like body can be given as an example of the shape of the mandrel 2. A primer treatment layer may be formed on its surface as required. The outer diameter of the mandrel desirably falls within the range of 4 mm to 10 mm.

<Elastic Layer>

In addition, the elastic layer is a molded body using a rubber or a resin as a raw material main component. In addition, the elastic layer may be any one of a foamed body and a non-foamed body. It should be noted that various rubbers that have been conventionally used in developing rollers can each be used as the rubber serving as the raw material main component. Specific examples thereof include the following: an ethylene-propylene-diene copolymer rubber (EPDM), an acrylonitrile-butadiene rubber (NBR), a chloroprene rubber (CR), a natural rubber (NR), an isoprene rubber (IR), a styrene-butadiene rubber (SBR), a fluororubber, a silicone rubber, an epichlorohydrin rubber, a hydrogenated product of NBR, a polysulfide rubber, and an urethane rubber. In addition, the resin as a raw material main component is typically a thermoplastic resin, and the examples thereof include the following: polyethylene-based resins such as a low-density polyethylene (LDPE), a high-density polyethylene (HDPE), a linear low-density polyethylene (LLDPE), and an ethylene-vinyl acetate copolymer resin (EVA); polypropylene-based resins; polycarbonate resins; polystylene-based resin; ABS resins; polyimides; polyester resins such as polyethylene terephthalate and polybutylene terephthalate; fluororesins; and polyamide resins such as polyamide 6, polyamide 66, and MXD6. In addition, one kind of those rubbers and resins is used alone, or two or more kinds thereof are used as a mixture. Although a raw material for the elastic layer in the present invention is not particularly limited, the silicone rubber out of those materials is preferably used because the silicone rubber shows weatherability, chemical inertness, and an excellent compression set characteristic.

Further, in the developing roller of the present invention, the rubber material as a main component can be appropriately blended with a component such as a conductive agent or a non-conductive filler needed for a function requested of the elastic layer itself, or with any one of the various additive components to be utilized upon formation of a rubber or resin molded body such as a crosslinking agent, a catalyst, and a dispersion accelerator.

An ion conductive substance based on an ionic conduction mechanism and a conductivity-imparting agent based on an electron conduction mechanism are each available as the conductive agent, and one of the two can be used or the two can be used in combination.

Examples of the conductive agent based on an electron conduction mechanism include the following: powders and fibers of metals such as aluminum, palladium, iron, copper, and silver; metal oxides such as titanium oxide, tin oxide, and zinc oxide; and carbon conductive agents such as furnace black, acetylene black, ketchen black, PAN-based carbon black, pitch-based carbon black, and a carbon nanotube.

In addition, examples of the conductivity-imparting agent based on an ionic conduction mechanism include the following: alkali metal salts such as $LiCF_3SO_3$, $NaClO_4$, $LiClO_4$, $LiAsF_6$, $LiBF_4$, NaSCN, KSCN, and NaCl; ammonium salts such as $NH_4Cl$, $NH_4SO_4$, and $NH_4NO_3$; alkaline earth metal salts such as $Ca(ClO_4)_2$ and $Ba(ClO_4)_2$; cationic surfactants such as a quaternary ammonium salt; anionic surfactants such as an aliphatic sulfonate, an alkyl sulfate, and an alkyl phosphate; and amphoteric surfactants such as betaine. One kind of those conductive agents can be used alone, or two or more kinds thereof can be used as a mixture.

Of those, a carbon black-based conductive agent is suitable because of the following reasons. The conductive agent is easily available at a relatively low cost. In addition, the conductive agent can impart good conductivity irrespective of the kind of the rubber or resin material as a main component.

Any one of the following means that have been conventionally utilized has only to be appropriately utilized as means for dispersing a fine powder-like conductive agent in the rubber or resin material as a main component depending on the rubber or resin material as a main component. Examples thereof include means such as a roll kneader and a Banbury mixer. In addition, the volume resistivity of the elastic layer preferably falls within the range of $1\times10^3$ to $1\times10^{11}$ Ω·cm. When the volume resistivity of the elastic layer is $1\times10^3$ to $1\times10^{11}$ Ω·cm, the toner can be uniformly charged. The volume resistivity of the elastic layer more preferably falls within the range of $1\times10^3$ to $1\times10^8$ Ω·cm.

Examples of the filler and the extender include the following: silica, a quartz fine powder, diatomaceous earth, zinc oxide, basic magnesium carbonate, activated calcium carbonate, magnesium silicate, aluminum silicate, titanium dioxide, talc, a mica powder, aluminum sulfate, calcium sulfate, barium sulfate, a glass fiber, an organic reinforcement, and an organic filler. The surface of each of those fillers may be treated with an organosilicon compound so as to be made hydrophobic. A known antioxidant to be used for a polymer compound such as a hindered phenol-based antioxidant, a phenol-based antioxidant, a phosphorus-based antioxidant, an amine-based antioxidant, or a sulfur-based antioxidant can be appropriately selected and used as the antioxidant. A known material can be used as the processing aid. Specifically, an aliphatic acid such as stearic acid or oleic acid, or a metal salt or ester of such aliphatic acid can be used.

It should be noted that the thickness of the elastic layer is preferably 0.5 mm or more, more preferably 1.0 mm or more in order that the elastic layer may abut the photosensitive member to secure a nip width and may satisfy suitable set property. In addition, there is no particular upper limit for the thickness of the elastic layer as long as the outer diameter accuracy of the developing roller to be produced is not impaired. However, it is not preferred to excessively increase the thickness of the elastic layer because of the following reason. When the developing roller and an abutting member are left to stand for a long period of time while being brought into abutment with each other, an abutting site largely deforms and strain remains. Therefore, as a matter of practicality, it is suitable to set the thickness of the elastic layer to 6.0 mm or less, and the thickness is more preferably 5.0 mm or less.

In addition, after the molding of the elastic layer, a surface treatment such as a corona treatment, a plasma treatment, a flame treatment, or a UV treatment can be performed as required. Performing any such surface treatment results in the formation of a reaction-active group on the outermost surface of the elastic layer, thereby enabling an improvement in interlayer adhesiveness with the surface layer.

It should be noted that in the present invention, the elastic layer can be molded by, for example, an extrusion molding method, compression molding, or an injection molding method which has been conventionally known. However, a method for the molding is not particularly limited. The construction of the layer is not limited as long as the construction has the features described in the present invention, and a construction formed of two or more layers is also permitted.

Figure 3:
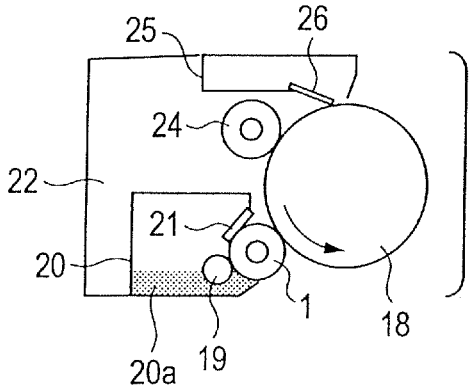
FIG. 3 is a sectional view of a process cartridge according to the present invention.

In addition, the present invention is a process cartridge illustrated in FIG. 3 having at least the developing roller 1, a toner-regulating member 21, and a toner container 20 containing a toner 20*a*, the process cartridge being removable from an electrophotographic apparatus including the developing roller. Further, the present invention is an electrophotographic apparatus for forming a visible image on a photosensitive member by: forming a thin layer of toner on the surface of the developing roller; and bringing the developing roller into contact with the photosensitive member to supply the toner to the surface of the photosensitive member. The process cartridge can be an all-in-one process cartridge integrated with a photosensitive member 18, a cleaning blade 26, a waste toner-storing container 25, and a charging member 24 like the process cartridge illustrated in FIG. 3. It should be noted that reference numeral 19 in FIG. 3 represents a toner-supplying roller.

Figure 4:
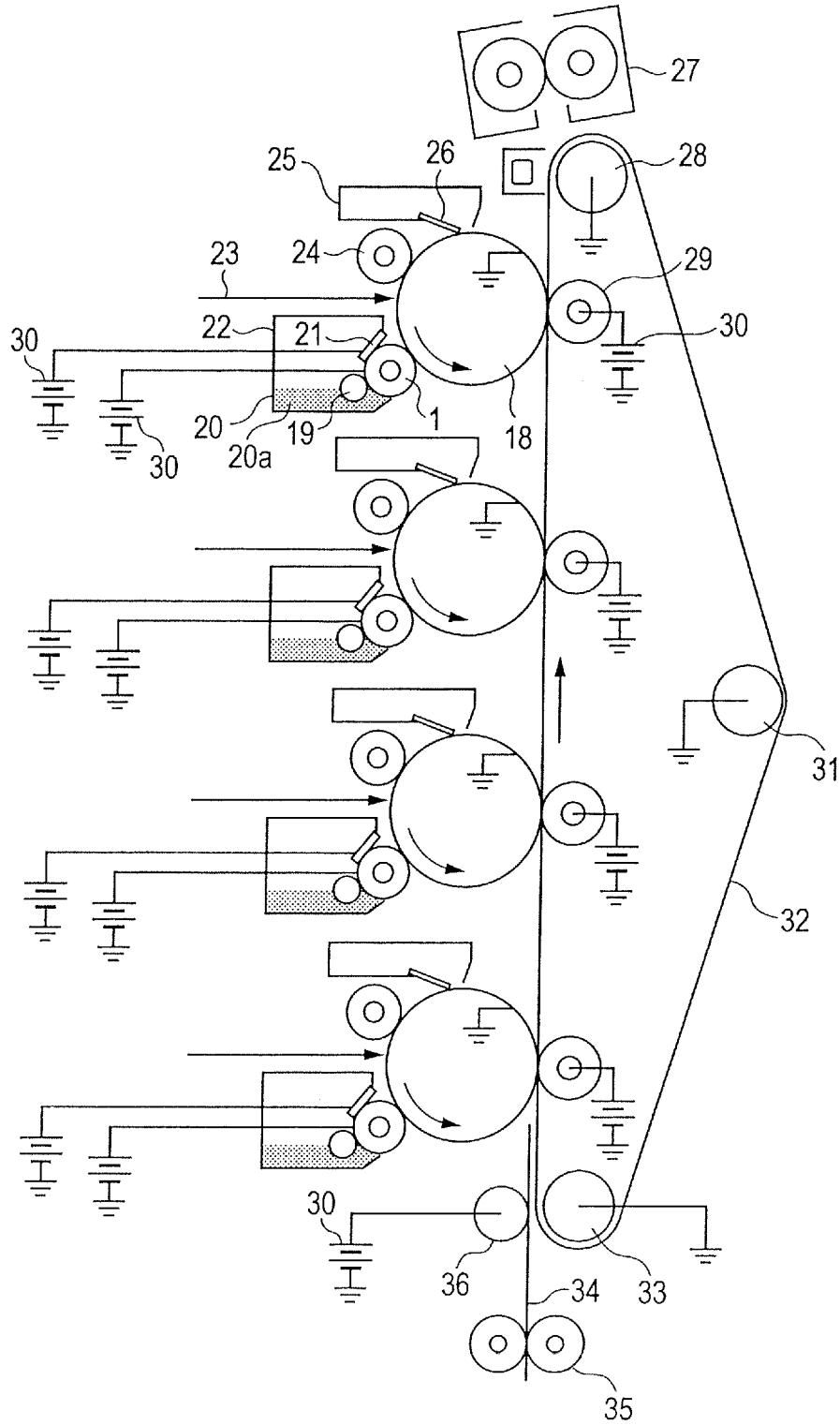
FIG. 4 is a sectional view of an electrophotographic apparatus according to the present invention.

FIG. 4 is a sectional view illustrating the schematic construction of an electrophotographic image-forming apparatus using a process cartridge including the developing roller of the present invention. The electrophotographic image-forming apparatus of FIG. 4 is removably mounted with: a developing apparatus 22 formed of the developing roller 1, the toner-supplying roller 19, the toner container 20, and the toner-regulating member 21; and a process cartridge 17 formed of the photosensitive member 18, the cleaning blade 26, the waste toner-storing container 25, and the charging member 24. In addition, the photosensitive member 18, the cleaning blade 26, the waste toner-storing container 25, and the charging member 24 may be deployed in the main body of the electrophotographic image-forming apparatus. The photosensitive member 18 rotates in the direction indicated by an arrow and is uniformly charged by the charging member 24 for subjecting the photosensitive member 18 to a charging treatment, and an electrostatic latent image is formed on its surface by a laser light 23 as exposing means for writing the electrostatic latent image on the photosensitive member 18. The electrostatic latent image is developed by being provided with a toner 20*a* from the developing apparatus 22 placed to contact the photosensitive member 18, and is then visualized as a toner image.

The development performed here is the so-called reversal development in which the toner image is formed on an exposing portion. The visualized toner image on the photosensitive member 18 is transferred onto a paper 34 as a recording medium by a transfer roller 29 as a transferring member. The paper 34 is fed into the apparatus via a sheet-feeding roller 35 and an adsorbing roller 36, and is then conveyed into a gap between the photosensitive member 18 and the transfer roller 29 by an endless belt-like transfer conveyance belt 32. The transfer conveyance belt is operated by a driven roller 33, a driving roller 28, and a tension roller 31. A voltage is applied from a bias power source 30 to each of the transfer roller 29 and the adsorbing roller 36. The paper 34 onto which the toner image has been transferred is subjected to a fixation treatment by a fixing apparatus 27, and is then discharged to the outside of the apparatus. Thus, a printing operation is terminated.

Meanwhile, transfer residual toner remaining on the photosensitive member 18 without being used in the transfer is scraped by the cleaning blade 26 as a cleaning member for cleaning the surface of the photosensitive member, and is then stored in the waste toner-storing container 25. The photosensitive member 18 thus cleaned repeatedly performs the foregoing action.

The developing apparatus 22 includes the developer container storing the toner 20*a* as a one-component developer, and the developing roller 1 as a developer carrier positioned at an opening portion extending in the longitudinal direction in the developer container and placed to be opposite to the photosensitive member 18, and is adapted to develop and visualize the electrostatic latent image on the photosensitive member 18.

In addition, a member obtained by fixing a rubber elastic body to a sheet metal made of a metal, or a member having spring property such as a thin plate of SUS or phosphor bronze or a member obtained by laminating a resin or a rubber on its surface is used as the toner-regulating member 21. In addition, when a voltage higher than a voltage to be applied the developing roller 1 is applied to the toner-regulating member 21, a toner layer on the developing roller can be controlled. To this end, a thin plate of SUS or phosphor bronze is preferably used as the toner-regulating member 21. A voltage is applied from the bias power source 30 to each of the developing roller 1 and the toner-regulating member 21. The voltage to be applied to the toner-regulating member 21 is preferably a voltage whose absolute value is larger than that of the voltage to be applied to the developing roller 1 by 100 V to 300 V.

A developing process in the developing apparatus 22 is described below. Toner is applied onto the developing roller 1 by the toner-supplying roller 19 that is rotatably supported. The toner applied onto the developing roller 1 is rubbed with the toner-regulating member 21 by the rotation of the developing roller 1. Here, the top of the developing roller is uniformly coated with the toner on the developing roller by a bias applied to the toner-regulating member 21. The developing roller 1 contacts the photosensitive member 18 while rotating, and then develops an electrostatic latent image formed on the photosensitive member 18 with the toner with which the top of the developing roller 1 has been coated. Thus, an image is formed.

The structure of the toner-supplying roller 19 is preferably a foamed skeleton-like sponge structure or a fur brush structure obtained by filling fibers of rayon, polyamide, or the like onto a mandrel in terms of the supply of the toner 20*a* to the developing roller 1 and the stripping of undeveloped toner. In this example, an elastic roller obtained by providing a polyurethane foam on a mandrel was used.

The abutting width of the toner-supplying roller 19 with respect to the developing roller 1 is preferably 1 to 8 mm. In addition, the developing roller 1 is preferably provided with a relative speed at the abutting portion.

Hereinafter, the developing roller, process cartridge, and electrophotographic apparatus of the present invention are specifically described in detail.

Subsequently, a prepolymer-type isocyanate compound to be used in the preparation of a coating fluid for forming the surface layer of a developing roller according to any one of the examples of the present invention and comparative examples was synthesized.

First, an isocyanate and a polyester polyol were prepared as raw materials for synthesizing the prepolymer-type isocyanate compound.

<Isocyanate>

Six kinds of isocyanates shown in Table 1 below were prepared.

TABLE 1

| Isocyanate No. | Material | Specific structure in molecule |
|---|---|---|
| 1 | Hexamethylene diisocyanate (HDI) (trade name: DURANATE 24A-100, manufactured by Asahi Kasei Corporation) | Chemical formula (c) |
| 2 | Trimethylhexamethylene diisocyanate (TM-HDI) (trade name: VESTANNT TMDI, manufactured by Evonik Degussa Japan Co., Ltd.) | Chemical formula (d), (e) |
| 3 | Norbornene diisocyanate (NBDI) (trade name: COSMONATE NBDI, manufactured by Mitsui Chemicals, Inc.) | Chemical formula (f) |
| 4 | Dimer acid diisocyanate (DDI) (trade name: PRIPOL-2033, manufactured by Uniqema International) | Chemical formula (g) |
| 5 | Xylene diisocyanate (XDI) (trade name: TAKENATE 500, manufactured by Mitsui Chemicals, Inc.) | — |
| 6 | Polyphenylmethylene diisocyanate (MDI) (trade name: MILLIONATE MR-200, manufactured by Nippon Polyurethane Industry Co., Ltd.) | — |

<Polyester Polyol>

Nine kinds of polyester polyols shown in Table 2 below were prepared as polyester polyols (group A) to be used in the synthesis of prepolymer-type isocyanate compounds.

TABLE 2

| Polyester polyol No. | Material | Specific structure contained in molecule |
|---|---|---|
| A-1 | Polycaprolactone polyol (trade name: PLACCEL 210, Mn = 1,000, manufactured by DAICEL CHEMICAL INDUSTRIES, LTD.) | Chemical formula (a) |
| A-2 | Polyester polyol (trade name: F-1010, formed of 3-methyl-1,5-pentanediol and adipic acid, Mn = 1,000, manufactured by KURARAY CO., LTD.) | Chemical formula (b) |
| A-3 | Polyester polyol (trade name: F-2010, formed of 3-methyl-1,5-pentanediol and adipic acid, Mn = 2,000, manufactured by KURARAY CO., LTD.) | Chemical formula (b) |
| A-4 | Polycaprolactone polyol (trade name: L-312AL, Mn = 1,250, manufactured by DAICEL CHEMICAL INDUSTRIES, LTD.) | Chemical formula (a) |

TABLE 2-continued

| Polyester polyol No. | Material | Specific structure contained in molecule |
|---|---|---|
| A-5 | Polycaprolactone polyol (trade name: L-205AL, Mn = 500, manufactured by DAICEL CHEMICAL INDUSTRIES, LTD.) | Chemical formula (a) |
| A-6 | Polycaprolactone polyol (trade name: L-320AL, Mn = 2,000, manufactured by DAICEL CHEMICAL INDUSTRIES, LTD.) | Chemical formula (a) |
| A-7 | Polyester diol (trade name: P-510, formed of 3-methyl-1,5-pentanediol and adipic acid, Mn = 500, manufactured by KURARAY CO., LTD.) | Chemical formula (b) |
| A-8 | Polyester polyol (trade name: YG-108, formed of 1,4-butanediol and adipic acid, Mn = 1,000, manufactured by ADEKA CORPORATION) | — |
| A-9 | Polyester polyol (trade name: N-2010, formed of 1,9-nonanediol and adipic acid, Mn = 2,000, manufactured by KURARAY CO., LTD.) | — |

<Other Materials>

Compounds shown in Table 3 below were prepared as other materials.

TABLE 3

| Other material No. | Material |
|---|---|
| 1 | Trimethylolpropane (TMP) (trade name: TMP (melt), manufactured by Mitsubishi Gas Chemical Company, Inc.) |
| 2 | Butyl cellosolve (trade name: Butyl Cellosolve, manufactured by SANKYO CHEMICAL CO., LTD.) |
| 3 | MEK oxime (trade name: MEK Oxime, manufactured by Ube Industries, Ltd.) |
| 4 | Bismuth 2-ethyl hexanoate (trade name: K-KAT348, manufactured by Kusumoto Chemicals, Ltd.) |

<Method of Synthesizing Prepolymer-Type Isocyanate Compound>

(Synthesis of Prepolymer-Type Isocyanate Compound 1 (Pre-BI 1))

Under a nitrogen atmosphere, materials shown in Table 4 below were caused to react with one another under heat at a temperature of 90° C. for 2 hours. After that, butyl cellosolve was added so that a solid content was 79.4 parts by mass.

TABLE 4

| Material | Part(s) by mass |
|---|---|
| Isocyanate No. 1 | 100 |
| Polyester polyol No. A-1 | 76.9 |
| Other material No. 4 (catalyst) | 0.05 |

After that, 28.1 parts by mass of MEK oxime were dropped under the condition of a reaction product temperature of 50° C. Thus, an ester-denatured prepolymer-type isocyanate compound Pre-BI 1 was obtained.

(Measurement of Number-Average Molecular Weight Mn by GPC)

The number-average molecular weight Mn of the resultant prepolymer-type isocyanate compound Pre-BI 1 was measured by the following method. That is, a high-performance liquid chromatography analyzer (trade name: HLC-8120GPC, manufactured by TOSOH CORPORATION) in which two GPC columns (trade name: TSKgel Super HM-M, manufactured by TOSOH CORPORATION) were connected in series was used. A THF solution prepared by dissolving 0.1 mass % of the Pre-BI 1 in THF was used as a measurement sample.

In addition, measurement conditions were a temperature of 40° C. and a flow rate of 0.6 ml/min. In addition, a calibration curve was created with several kinds of monodisperse standard polystyrenes (manufactured by TOSOH CORPORATION) as standard samples under such a measurement condition that a refractive index detector (trade name: RI-8010; manufactured by TOSOH CORPORATION) was used. The number-average molecular weight (Mn) was determined from the retention time of the measurement sample obtained on the basis of the curve.

Table 1 shows the physical properties and structure of the resultant prepolymer-type isocyanate compound 1 (Pre-BI 1) together with the raw materials used in its synthesis and their parts by mass.

(Synthesis of Prepolymer-Type Isocyanate Compound (Pre-BI 2) to Prepolymer-Type Isocyanate Compound (Pre-BI 24))

(Pre-BI 2) to (Pre-BI 24) were each produced in the same manner as in the (Pre-BI 1) with starting materials shown in Table 1, Table 2 and Table 3. It should be noted that trimethylolpropane (TMP) was added to the mixture of a polyol and an isocyanate compound before being subjected to the reaction under heat at 90° C. Table 5 below shows the physical properties and structures of the (Pre-BI 2) to (Pre-BI 24).

Subsequently, the coating fluid for forming the surface layer of the developing roller according to any one of the examples and the comparative examples was prepared. Here, a coating fluid for forming the surface layer was prepared with starting materials formed of a polyester polyol in a group B shown below, a prepolymer-type isocyanate compound synthesized in the foregoing, carbon black shown below, and an organometallic catalyst.

<Polyester Polyols (Group B)>

Fifteen (15) kinds of polyester polyols shown in Table 6 below were prepared as polyester polyols (group B) to be used in the synthesis of urethane resins.

TABLE 6

| Polyester polyol No. | Material |
|---|---|
| B-1 | Polycaprolactone polyol (trade name: PLACCEL 240, Mn = 4,000, manufactured by DAICEL CHEMICAL INDUSTRIES, LTD.) |
| B-2 | Polyester diol (trade name: P-3010, formed of 3-methyl-1,5-pentanediol and adipic acid, Mn = 3,000, manufactured by KURARAY CO., LTD.) |
| B-3 | Polycaprolactone polyol (trade name: PLACCEL 230, Mn = 3,000, manufactured by DAICEL CHEMICAL INDUSTRIES, LTD.) |
| B-4 | Polyester polyol (trade name: P-2010, formed of 3-methyl-1,5-pentanediol and adipic acid, Mn = 2,000, manufactured by KURARAY CO., LTD.) |
| B-5 | Polyester diol (trade name: P-2050, formed of 3-methyl-1,5-pentanediol and sebacic acid, Mn = 2,000, manufactured by KURARAY CO., LTD.) |

TABLE 5

| Prepolymer-type isocyanate compound | | | Raw material for synthesizing prepolymer-type isocyanate compound | | | | | | |
|---|---|---|---|---|---|---|---|---|---|
| | | | | | | | Other raw material | | |
| | | Specific | Isocyanate | | Polyester polyol | | No. 1 | No. 2 | No. 3 |
| No. | Mn | structure present in molecule | No. | Part(s) by mass | No. | Part(s) by mass | (Part(s) by mass) | (Part(s) by mass) | (Part(s) by mass) |
| Pre-BI 1 | 14,000 | (a), (c) | 1 | 76.9 | A-1 | 100 | 0 | 79.4 | 0.05 |
| Pre-BI 2 | 13,000 | (b), (c) | 1 | 76.2 | A-2 | 100 | 0 | 80.5 | 0.05 |
| Pre-BI 3 | 8,000 | (a), (c) | 1 | 87.9 | A-1 | 100 | 0 | 103.0 | 0.05 |
| Pre-BI 4 | 9,000 | (b), (c) | 1 | 78.8 | A-2 | 100 | 0 | 92.7 | 0.05 |
| Pre-BI 5 | 6,000 | (b), (c) | 1 | 92.0 | A-2 | 100 | 0 | 106.0 | 0.05 |
| Pre-BI 6 | 10,000 | (a), (c) | 1 | 62.8 | A-4 | 100 | 0 | 87.3 | 0.05 |
| Pre-BI 7 | 14,000 | (a), (d), (e) | 2 | 71.0 | A-1 | 100 | 0 | 99.2 | 0.05 |
| Pre-BI 8 | 13,000 | (b), (d), (e) | 2 | 65.9 | A-2 | 100 | 0 | 95.2 | 0.05 |
| Pre-BI 9 | 7,000 | (a), (d), (e) | 2 | 52.6 | A-4 | 100 | 0 | 89.9 | 0.05 |
| Pre-BI 10 | 8,000 | (b), (d), (e) | 2 | 75.3 | A-2 | 100 | 0 | 103.0 | 0.05 |
| Pre-BI 11 | 5,000 | (a), (d), (e) | 2 | 99.0 | A-5 | 100 | 4 | 87.3 | 0.05 |
| Pre-BI 12 | 6,000 | (b), (d), (e) | 2 | 110.5 | A-7 | 100 | 4 | 116.0 | 0.05 |
| Pre-BI 13 | 8,000 | (a), (f) | 3 | 52.2 | A-1 | 100 | 0 | 95.2 | 0.05 |
| Pre-BI 14 | 9,000 | (b), (f) | 3 | 48.4 | A-2 | 100 | 0 | 91.3 | 0.05 |
| Pre-BI 15 | 9,000 | (a), (g) | 4 | 68.9 | A-1 | 100 | 0 | 89.9 | 0.05 |
| Pre-BI 16 | 10,000 | (b), (g) | 4 | 64.6 | A-2 | 100 | 0 | 85.9 | 0.05 |
| Pre-BI 17 | 12,000 | (b), (c) | 1 | 39.9 | A-3 | 100 | 0 | 74.3 | 0.05 |
| Pre-BI 18 | 7,000 | (c) | 1 | 64.9 | A-7 | 100 | 2 | 75.6 | 0.05 |
| Pre-BI 19 | 9,000 | (c) | 1 | 31.6 | A-9 | 100 | 1 | 70.0 | 0.05 |
| Pre-BI 20 | 7,000 | (a) | 5 | 31.5 | A-6 | 100 | 0 | 74.0 | 0 |
| Pre-BI 21 | 9,000 | (b) | 5 | 29.0 | A-3 | 100 | 0 | 66.1 | 0 |
| Pre-BI 22 | 8,000 | (a) | 6 | 30.2 | A-6 | 100 | 0 | 98.7 | 0 |
| Pre-BI 23 | 8,000 | (b) | 6 | 29.2 | A-3 | 100 | 0 | 71.5 | 0 |
| Pre-BI 24 | 15,000 | (b), (c) | 1 | 42.6 | A-3 | 100 | 0 | 79.4 | 0.05 |

TABLE 6-continued

| Polyester polyol No. | Material |
|---|---|
| B-6 | Polycaprolactone polyol (trade name: L-205AL, Mn = 500, manufactured by DAICEL CHEMICAL INDUSTRIES, LTD.) |
| B-7 | Polyester diol (trade name: P-510, formed of 3-methyl-1,5-pentanediol and adipic acid, Mn = 500, manufactured by KURARAY CO., LTD.) |
| B-8 | Polycaprolactone polyol (trade name: L-212AL, Mn = 1,250, manufactured by DAICEL CHEMICAL INDUSTRIES, LTD.) |
| B-9 | Polyester polyol (trade name: P-1010, formed of 3-methyl-1,5-pentanediol and adipic acid, Mn = 1,000, manufactured by KURARAY CO., LTD.) |
| B-10 | Polyester polyol (trade name: P-3050, formed of 3-methyl-1,5-pentanediol and sebacic acid, Mn = 3,000, manufactured by KURARAY CO., LTD.) |
| B-11 | Polycaprolactone polyol (trade name: PLACCEL 210, Mn = 1,000, manufactured by DAICEL CHEMICAL INDUSTRIES, LTD.) |
| B-12 | Polyester polyol (trade name: YG-108, formed of 1,4-butanediol and adipic acid, Mn = 1,000, manufactured by ADEKA CORPORATION) |
| B-13 | Polyester polyol (trade name: O-2010, formed of 1,8-octanediol and adipic acid, Mn = 2,000, manufactured by KURARAY CO., LTD.) |
| B-14 | Polyester polyol (trade name: P-4010, formed of 3-methyl-1,5-pentanediol and sebacic acid, Mn = 4,000, manufactured by KURARAY CO., LTD.) |
| B-15 | Polyester polyol (trade name: P-5010, formed of 3-methyl-1,5-pentanediol and sebacic acid, Mn = 5,000, manufactured by KURARAY CO., LTD.) |

Carbon black> Four kinds of carbon blacks shown in Table 7 below were prepared.

TABLE 7

| Carbon black No. | |
|---|---|
| 1 | Acidic carbon (trade name: MA-100, average primary particle diameter: 22 nm, DBP absorption: 100 ml/100 g, pH: 3.5, manufactured by Mitsubishi Chemical Corporation) |
| 2 | Acidic carbon (trade name: MA-11, average primary particle diameter: 29 nm, DBP absorption: 64 ml/100 g, pH: 3.5, manufactured by Mitsubishi Chemical Corporation) |
| 3 | Acidic carbon (trade name: #8300-F, average primary particle diameter: 16 nm, DBP absorption: 76 ml/100 g, pH: 5.0, manufactured by TOKAI CARBON CO., LTD.) |
| 4 | Basic carbon (trade name: XC-7230, average primary particle diameter: 30 nm, DBP absorption: 174 ml/100 g, pH: 8.5, manufactured by Cabot Corporation) |

<Organometallic Catalyst>

Organometallic catalysts shown in Table 8 below were prepared.

TABLE 8

| Organometallic catalyst No. | |
|---|---|
| 1 | Dibutyltin dilaurate (trade name: DBTL KS-1260, manufactured by KYODO CHEMICAL COMPANY LIMITED) |
| 2 | Titanium-ethyl acetoacetate chelate (trade name: TC-750, manufactured by Matsumoto Fine Chemical Co., Ltd.) |
| 3 | Bismuth 2-ethyl hexanoate (trade name: K-KAT348, manufactured by Kusumoto Chemicals, Ltd.) |

<Preparation of Coating Fluid (1) for Forming Surface Layer>

Materials shown in Table 9 below as materials for the coating fluid for forming the surface layer were mixed so that a polyester-polyurethane resin component was obtained.

TABLE 9

| Material | Part(s) by mass |
|---|---|
| Polyester polyol No. B-1 | 100 |
| Pre-BI 1 | 43.1 |

Subsequently, 15 parts by mass of carbon black (trade name: XC-7230, manufactured by Cabot Corporation) and MEK were added to 100 parts by mass of the solid content of the resin component, and then the contents were mixed and stirred with a motor for 1 hour.

Subsequently, MEK was further added so that the total solid content ratio was 33 mass %, and then the contents were mixed and stirred with the motor for an additional one hour. Subsequently, the mixed solution was uniformly dispersed with a horizontal dispersing machine NVM-03 (trade name, manufactured by IMEX Co., Ltd.) for 3 hours under the conditions of a circumferential speed of 7 m/sec, a flow rate of 1 cc/min, and a dispersion liquid temperature of 15° C. It should be noted that glass beads each having a diameter of 1.5 mm (trade name: DMB503B, manufactured by Potters-Ballotini Co., Ltd.) were used at the time of the dispersion.

Next, polyurethane fine particles (trade name: DAIMIC BEADS UCN-5070N, manufactured by Dainichiseika Color & Chemicals Mfg. Co., Ltd.) were added as resin particles for roughness adjustment in a content of 35 parts by mass with respect to 100 parts by mass of the solid content of the resin component, and then the resultant was dispersed for an additional thirty minutes.

Next, the solution was diluted with MEK to a solid content of 23 mass % so that a thickness after the formation of the surface layer was 10 μm. The solution was filtrated with a 300-mesh screen. The filtrate was defined as a coating fluid (1) for forming the surface layer.

<Preparation of Coating Fluids (2) to (43) for Forming Surface Layer>

Coating fluids (2) to (43) for forming the surface layer were each prepared in the same manner as in the coating fluid (1) for forming the surface layer except that starting materials shown in Table 10 were used. It should be noted that when an organometallic catalyst was used, the catalyst was added before the motor stirring.

<Preparation of Coating Fluid (44) for Forming Surface Layer>

A coating fluid (44) for forming the surface layer in the present invention was prepared in the same manner as in the coating fluid (1) for forming the surface layer except that: starting materials shown in Table 10 were used; and the final coating fluid solid content was changed from 23 mass % to 5 mass % so that the thickness of the surface layer was 1 μm.

TABLE 10

| Coating fluid No. for forming surface layer | Polyester polyol | | Prepolymer-type isocyanate compound | | Organometallic catalyst | | Carbon black | |
|---|---|---|---|---|---|---|---|---|
| | No | Part(s) by mass | No | Part(s) by mass | No | Part(s) by mass | No. | Part(s) by mass |
| (1) | B-1 | 100 | Pre-BI 1 | 43.1 | — | — | 4 | 15 |
| (2) | B-2 | 100 | Pre-BI 2 | 54.9 | — | — | 4 | 15 |
| (3) | B-3 | 100 | Pre-BI 3 | 20.8 | — | — | 1 | 20 |
| (4) | B-4 | 100 | Pre-BI 4 | 71.2 | — | — | 1 | 20 |
| (5) | B-6 | 100 | Pre-BI 3 | 264.9 | — | — | 2 | 30 |
| (6) | B-7 | 100 | Pre-BI 5 | 249.3 | — | — | 2 | 30 |
| (7) | B-9 | 100 | Pre-BI 4 | 141.2 | 3 | 0.04 | 1 | 20 |
| (8) | B-9 | 100 | Pre-BI 4 | 141.2 | 3 | 0.05 | 1 | 20 |
| (9) | B-9 | 100 | Pre-BI 4 | 141.2 | 3 | 1.00 | 1 | 20 |
| (10) | B-8 | 100 | Pre-BI 6 | 123.7 | 3 | 1.00 | 1 | 20 |
| (11) | B-9 | 100 | Pre-BI 4 | 141.2 | 3 | 2.00 | 1 | 20 |
| (12) | B-9 | 100 | Pre-BI 4 | 141.2 | 3 | 2.20 | 1 | 20 |
| (13) | B-9 | 100 | Pre-BI 4 | 141.2 | 2 | 0.04 | 1 | 20 |
| (14) | B-9 | 100 | Pre-BI 4 | 141.2 | 2 | 0.05 | 1 | 20 |
| (15) | B-9 | 100 | Pre-BI 4 | 141.2 | 2 | 1.00 | 1 | 20 |
| (16) | B-8 | 100 | Pre-BI 6 | 123.7 | 2 | 1.00 | 1 | 20 |
| (17) | B-9 | 100 | Pre-BI 4 | 141.2 | 2 | 2.00 | 1 | 20 |
| (18) | B-9 | 100 | Pre-BI 4 | 141.2 | 2 | 2.20 | 1 | 20 |
| (19) | B-1 | 100 | Pre-BI 7 | 34.5 | 3 | 1.00 | 4 | 15 |
| (20) | B-10 | 100 | Pre-BI 8 | 46.5 | 3 | 1.00 | 4 | 15 |
| (21) | B-8 | 100 | Pre-BI 9 | 113.4 | 3 | 1.00 | 1 | 20 |
| (22) | B-9 | 100 | Pre-BI 10 | 126.7 | 3 | 1.00 | 1 | 20 |
| (23) | B-11 | 100 | Pre-BI 11 | 167.7 | 3 | 1.00 | 2 | 30 |
| (24) | B-7 | 100 | Pre-BI 12 | 249.3 | 3 | 1.00 | 2 | 30 |
| (25) | B-8 | 100 | Pre-BI 13 | 113.4 | 3 | 1.00 | 1 | 20 |
| (26) | B-9 | 100 | Pre-BI 14 | 143.2 | 3 | 1.00 | 1 | 20 |
| (27) | B-8 | 100 | Pre-BI 15 | 120.1 | 3 | 1.00 | 1 | 20 |
| (28) | B-9 | 100 | Pre-BI 16 | 152.0 | 3 | 1.00 | 1 | 20 |
| (29) | B-9 | 100 | Pre-BI 17 | 176.5 | 1 | 0.04 | 1 | 20 |
| (30) | B-9 | 100 | Pre-BI 17 | 176.5 | 1 | 0.05 | 1 | 20 |
| (31) | B-9 | 100 | Pre-BI 17 | 176.5 | 1 | 1.00 | 1 | 20 |
| (32) | B-9 | 100 | Pre-BI 17 | 176.5 | 1 | 2.00 | 1 | 20 |
| (33) | B-9 | 100 | Pre-BI 17 | 176.5 | 1 | 2.20 | 1 | 20 |
| (34) | B-12 | 100 | Pre-BI 18 | 209.0 | — | — | 1 | 20 |
| (35) | B-13 | 100 | Pre-BI 19 | 107.1 | — | — | 1 | 20 |
| (36) | B-1 | 100 | Pre-BI 20 | 46.2 | — | — | 1 | 20 |
| (37) | B-14 | 100 | Pre-BI 21 | 49.4 | — | — | 1 | 20 |
| (38) | B-1 | 100 | Pre-BI 22 | 49.8 | — | — | 1 | 20 |
| (39) | B-14 | 100 | Pre-BI 23 | 45.8 | — | — | 1 | 20 |
| (40) | B-6 | 100 | Pre-BI 6 | 313.1 | — | — | 3 | 30 |
| (41) | B-1 | 100 | Pre-BI 24 | 43.1 | — | — | 1 | 15 |
| (42) | B-7 | 100 | Pre-BI 12 | 249.3 | — | — | 2 | 30 |
| (43) | B-15 | 100 | Pre-BI 17 | 36.3 | — | — | 4 | 15 |
| (44) | B-6 | 100 | Pre-BI 22 | 397.4 | — | — | — | 0 |

Example 1

Production of Elastic Layer Roller 1

An elastic layer roller (1) was produced as described below.

A mandrel made of stainless steel (SUS304) having a diameter of 8 mm was prepared as a mandrel. A primer (trade name: DY35-051, manufactured by Dow Corning Toray Co., Ltd.) was applied to the peripheral surface of the mandrel, and was then baked at a temperature of 150° C. for 30 minutes. The thickness of the primer after the baking was 1 μm.

A base material A for a liquid silicone rubber having a vinyl group was prepared by mixing materials shown in Table 11 below.

TABLE 11

| Material | Part(s) by mass |
|---|---|
| Dimethylpolysiloxane (having vinyl groups at both terminals and having a weight-average molecular weight (Mw) of 50,000) | 50 |

TABLE 11-continued

| Material | Part(s) by mass |
|---|---|
| Dimethylpolysiloxane (having vinyl groups at both terminals and having an Mw of 1,000,000) | 50 |
| Carbon black (trade name: Raven 860 Ultra, manufactured by Columbian Chemicals) | 8 |

A base material B for a liquid silicone rubber having an SiH group and a vinyl group was prepared by mixing materials shown in Table 12 below.

TABLE 12

| Material | Part(s) by mass |
|---|---|
| Dimethylpolysiloxane (having vinyl groups at both terminals and having a weight-average molecular weight (Mw) of 50,000) | 50 |
| Dimethylpolysiloxane (having vinyl groups at both terminals and having an Mw of 1,000,000) | 50 |
| Carbon black (trade name: Raven 860 Ultra, manufactured by Columbian Chemicals) | 8 |
| Curing catalyst (obtained by blending a 2-mass % solution of chloroplatinic acid in isopropanol in a content of 10 ppm with respect to dimethylpolysiloxane) | 0.5 |
| Methylhydrogenpolysiloxane | 3 |
| | * Such an amount that the number of moles of an SiH group is 1.1 mol with respect to 1 mol of a vinyl group to be incorporated into the base material A for a liquid silicone rubber and the base material B for a liquid silicone rubber |

The base material A and the base material B were mixed at a mass ratio of 1:1 so that an unvulcanized silicone rubber material was obtained. Next, the mandrel was placed in a cylindrical die, and then the unvulcanized silicone rubber material was poured into the die (cavity). Subsequently, the die was heated so that the silicone rubber material was vulcanized and cured at a temperature of 150° C. for 15 minutes. After that, the resultant was cooled and removed from the die. After that, the resultant was heated at a temperature of 180° C. for 1 hour so that the curing reaction was completed. Thus, the elastic layer roller 1 having, on the periphery of the mandrel, an elastic layer formed of a silicone rubber was formed. The elastic layer roller 1 had a diameter of 12 mm.

<Production of Developing Roller 1>

The surface of the elastic layer of the elastic layer roller 1 was subjected to an excimer UV treatment. Specifically, while the elastic layer roller (1) was rotated at 30 rpm with its mandrel as a rotational axis, the surface was irradiated with ultraviolet light having a wavelength of 172 nm from a capillary excimer lamp (manufactured by HARISON TOSHIBA LIGHTING Corporation) so that an accumulated light quantity was 150 mJ/cm$^2$. It should be noted that a distance between the surface of the elastic layer and the excimer lamp at the time of the irradiation was 2 mm.

After that, the peripheral surface of the elastic layer of the elastic layer roller (1) subjected to the surface treatment was coated with the coating fluid (1) for forming the surface layer prepared in advance with the dip coating apparatus illustrated in FIG. 2.

Specifically, the coating fluid (1) for forming the surface layer whose temperature was kept at 23° C. was poured at 250 cc/min from the lower portion of the dipping tank 5 (cylinder) having an inner diameter of 32 mm and a length of 300 mm, and then the liquid spilling from the upper end of the dipping tank 5 was circulated toward the lower portion of the dipping tank 5 again. The elastic layer roller (1) was dipped in the dipping tank 5 at an immersion speed of 100 mm/s. Then, the elastic layer roller (1) was stopped for 10 seconds, and was then lifted under the conditions of an initial speed of 300 mm/s and a final velocity of 200 mm/s, followed by air drying for 60 minutes. Next, the coating film of the coating fluid 1 for forming the surface layer applied to the surface of the elastic layer was cured through heating at 140° C. for 2 hours so that the surface layer was formed. Thus, the developing roller 1 according to Example 1 was obtained.

The surface layer of the developing roller 1 was cut out with a manipulator so that a sample for measuring the storage modulus E' was prepared. Specifically, the measurement sample was produced by: cutting the surface layer in a sheet shape measuring 0.5 mm wide by 2 mm long out of the elastic layer of the developing roller with the manipulator; and when such sheet had a thickness of 50 μm or less, superimposing such sheets as required so that the total thickness was 50 μm. The storage modulus E' of the resultant measurement sample was measured with a dynamic viscoelasticity apparatus (trade name: EPLEXOR-500N, manufactured by GABO) under the following conditions.

(Measurement Conditions)

Measurement mode: A tensile test mode
Measuring frequency: 10 Hz
Measuring temperature: 0° C.
Transducer: 25 N
Dynamic strain: 0.1%
Static strain: 0.2%
Measurement sample shape: A shape measuring 0.5 mm wide by 2 mm long by 50 μm thick (Image Evaluation)

An electrophotographic image was formed with the developing roller 1. Then, the developing roller 1 was evaluated through the evaluation of the electrophotographic image.

First, a laser printer used in the image evaluation (trade name: HPColor LaserJet CP3505dn, manufactured by Hewlett-Packard Company) was reconstructed so as to output recording media at a speed of 48 ppm. In addition, the pressure at which the developing roller 1 abutted a toner amount-regulating member (developing blade) and the amount in which the roller entered the member were regulated so that the amount of the toner carried by the developing roller was 0.40 mg/cm$^2$.

(Evaluation for Bleeding after Long-Term Storage in High-Temperature, High-Humidity Environment)

The developing roller 1 was mounted on an electrophotographic process cartridge (trade name: Q6470A, manufactured by Hewlett-Packard Company, color: black). At this time, the developing roller 1 is in a state of abutting an electrophotographic photosensitive member. The electrophotographic process cartridge was left to stand in an environment having a temperature of 40° C. and a humidity of 95% RH for 30 days. After that, the cartridge was further left to stand in an environment having a temperature of 23° C. and a humidity of 50% RH for 72 hours.

After that, the electrophotographic process cartridge was mounted on the laser printer in the environment having a temperature of 23° C. and a humidity of 50% RH, and then 10 halftone images were continuously output.

Here, the term "halftone image" refers to such an image that horizontal lines each having a width of 1 dot are drawn in the rotational direction of the electrophotographic photosensitive member and a direction vertical thereto at an interval of 2 dots.

After that, the electrophotographic process cartridge was taken out of the laser printer, and then the developing roller 1 was taken out of the electrophotographic process cartridge.

The surface of the developing roller thus taken out was subjected to air blowing so that the toner was removed. Then, the surface of the developing roller was observed with a digital microscope (trade name: VH-2450, KEYENCE CORPORATION) so that the presence or absence of a bleeding product on the surface of the developing roller was observed.

In addition, the 10 halftone images were each visually observed and evaluated for the presence or absence of an image failure resulting from the adhesion of the bleeding product to the surface of the developing roller.

Table 13 below shows evaluation criteria.

TABLE 13

| Evaluation rank | Evaluation criterion |
|---|---|
| A | No bleeding product could be observed on the surface of the developing roller. In addition, unevenness resulting from the bleeding product is not observed in any one of the 10 halftone images. |
| B | A bleeding product was very slightly observed on the surface of the developing roller. In addition, unevenness resulting from the bleeding product was observed in the first halftone image initially output. However, the unevenness resulting from the bleeding product disappeared in the fifth halftone image. |
| C | A bleeding product was observed on the surface of the developing roller. In addition, unevenness resulting from the bleeding product was observed in the first halftone image. However, the unevenness resulting from the bleeding product disappeared in the tenth halftone image. |
| D | A bleeding product was observed on the surface of the developing roller. In addition, unevenness resulting from the bleeding product was observed in the first halftone image. In addition, the unevenness resulting from the bleeding product was still observed even in the tenth halftone image. |

(Evaluation for Toner Fusion in Low-Temperature, Low-Humidity Environment)

The brand-new developing roller 1 was mounted on a brand-new process cartridge (trade name: Q6470A, manufactured by Hewlett-Packard Company, color: black), and then the process cartridge was left to stand in an environment having a temperature of 0° C. and a humidity of 10% RH for 48 hours. After that, under the same environment, the process cartridge was mounted on the laser printer, and then electrophotographic images were continuously output. Specifically, the following cycle was repeated. 1,000 Images in each of which the letter of an alphabet "E" having a size of 4 points was printed on A4-sized paper so as to have a print percentage of 1% (hereinafter referred to as "E-letter image") were continuously output, and then 1 solid white image was output.

In such image output test, when toner fuses to the surface of the developing roller, the resistance of the developing roller increases. As a result, the triboelectric charge of the toner becomes nonuniform and hence fogging is apt to occur on the solid white image.

In view of the foregoing, an evaluation for the extent to which the toner fused to the surface of the developing roller in a low-temperature, low-humidity environment was performed as described below. That is, the developing roller immediately after the formation of the solid white image was taken out of the process cartridge, and then the toner adhering to its surface was removed by air blowing. After that, the surface was visually observed, and then the presence or absence of the fusion of the toner to the surface of the developing roller and the extent of the fusion were observed. In addition, the solid white image formed at that time was evaluated for the presence or absence of fogging resulting from the fusion of the toner to the developing roller. The evaluation for fogging was performed by measuring the reflectance of the solid white image with a reflection densitometer (manufactured by Gretag Macbeth) and calculating a reduction ratio (%) of the reflectance with reference to the reflectance of the paper itself.

Then, the output of the E-letter images was stopped at the point in time when the reduction ratio of the reflectance of the solid white image exceeded 3%. On the other hand, when the reduction ratio of the reflectance of the solid white image output after the number of output E-letter images had reached 8,000 did not reach 3%, the developing roller was built in a brand-new process cartridge, and then the output of the 1,000 E-letter images and the output of the solid white image subsequent thereto were repeated in the same manner as in the foregoing. In addition, the number of output E-letter images when the reduction ratio of the reflectance of the solid white image exceeded 3% was recorded. Specifically, when the reduction ratio of the reflectance of the solid white image after the output of the 7,000 E-letter images did not reach 3%, and the reduction ratio of the reflectance of the solid white image after the output of the 8,000 E-letter images was 3.6%, the term "8,000 images (3.6%)" is described in Table 14 below.

On the other hand, when the reduction ratio of the reflectance of the solid white image output after the number of output E-letter images had reached 12,000 was 1.8%, the term "12,000 images (1.8%)" is described therein. Table 14 shows the results of the evaluation.

Examples 2 to 33

Developing rollers (2) to (33) were produced in the same manner as in Example 1 except that the coating fluids (2) to (33) for forming the surface layer were used instead of the coating fluid (1) for forming the surface layer in Example 1. The developing rollers (2) to (33) were evaluated in the same manner as in the developing roller (1) of Example 1. Table 14 shows the results of the evaluations.

Comparative Examples 1 to 11

Developing rollers (34) to (44) were produced in the same manner as in Example 1 except that the coating fluids (34) to (44) for forming the surface layer were used instead of the coating fluid (1) for forming the surface layer in Example 1. The developing rollers (34) to (44) were evaluated in the same manner as in the developing roller (1) of Example 1. Table 15 shows the results of the evaluations.

TABLE 14

| | | | | | Image evaluation | | |
|---|---|---|---|---|---|---|---|
| | Coating fluid No. for forming | Specific structure present in molecule | | Storage modulus of surface layer | Evaluation for | | Number of output E-letter images when reduction ratio of reflectance |
| Example | surface layer | A | B | E' (MPa) | bleeding | External appearance | exceeded 3% |
| 1 | (1) | (a) | (c) | 5 | C | Toner fused to both end portions of roller. | 8,000 images (3.6%) |

TABLE 14-continued

| | | | | | Image evaluation | | |
|---|---|---|---|---|---|---|---|
| Example | Coating fluid No. for forming surface layer | Specific structure present in molecule A | Specific structure present in molecule B | Storage modulus of surface layer E' (MPa) | Evaluation for bleeding | External appearance | Number of output E-letter images when reduction ratio of reflectance exceeded 3% |
| 2 | (2) | (b) | (c) | 5 | C | Fusion was very slightly observed. | 12,000 images (1.8%) |
| 3 | (3) | (a) | (c) | 10 | C | Toner fused to both end portions of roller. | 9,000 images (3.2%) |
| 4 | (4) | (b) | (c) | 10 | C | Toner fused to both end portions of roller. | 10,000 images (3.5%) |
| 5 | (5) | (a) | (c) | 20 | B | Toner fused to entire surface. | 6,000 images (3.4%) |
| 6 | (6) | (b) | (c) | 20 | B | Toner fused to both end portions of roller. | 8,000 images (3.4%) |
| 7 | (7) | (b) | (c) | 7 | B | Fusion was very slightly observed. | 12,000 images (2,7%) |
| 8 | (8) | (b) | (c) | 8 | B | No fusion was observed. | 12,000 images (2.2%) |
| 9 | (9) | (b) | (c) | 10 | A | No fusion was observed. | 12,000 images (0.5%) |
| 10 | (10) | (a) | (c) | 12 | A | No fusion was observed. | 12,000 images (1.0%) |
| 11 | (11) | (b) | (c) | 11 | B | No fusion was observed. | 12,000 images (1.8%) |
| 12 | (12) | (b) | (c) | 11 | C | Fusion was very slightly observed. | 12,000 images (2.5%) |
| 13 | (13) | (b) | (c) | 8 | B | Fusion was very slightly observed. | 12,000 images (2.9%) |
| 14 | (14) | (b) | (c) | 8 | B | No fusion was observed. | 12,000 images (2.0%) |
| 15 | (15) | (b) | (c) | 11 | A | No fusion was observed. | 12,000 images (0.8%) |
| 16 | (16) | (a) | (c) | 13 | A | No fusion was observed. | 12,000 images (0.8%) |
| 17 | (17) | (b) | (c) | 11 | B | No fusion was observed. | 12,000 images (2.1%) |
| 18 | (18) | (b) | (c) | 11 | C | Fusion was very slightly observed. | 12,000 images (2.8%) |
| 19 | (19) | (a) | (d), (e) | 5 | C | Fusion was very slightly observed. | 12,000 images (2.3%) |
| 20 | (20) | (b) | (d), (e) | 5 | B | No fusion was observed. | 12,000 images (1.1%) |
| 21 | (21) | (a) | (d), (e) | 10 | A | No fusion was observed. | 12,000 images (1.3%) |
| 22 | (22) | (b) | (d), (e) | 10 | A | No fusion was observed. | 12,000 images (0.8%) |
| 23 | (23) | (a) | (d), (e) | 20 | A | Toner fused to entire surface. | 7,000 images (3.8%) |
| 24 | (24) | (b) | (d), (e) | 20 | A | Toner fused to both end portions of roller. | 11,000 images (3.4%) |
| 25 | (25) | (a) | (f) | 13 | A | Fusion was very slightly observed. | 10,000 images (3.7%) |
| 26 | (26) | (b) | (f) | 11 | A | Fusion was very slightly observed. | 12,000 images (2.0%) |
| 27 | (27) | (a) | (g) | 9 | C | Fusion was very slightly observed. | 12,000 images (2.7%) |
| 28 | (28) | (b) | (g) | 8 | B | Fusion was very slightly observed. | 12,000 images (1.9%) |
| 29 | (29) | (b) | (c) | 11 | C | Fusion was very slightly observed. | 9,000 images (3.4%) |
| 30 | (30) | (b) | (c) | 12 | C | Fusion was very slightly observed. | 12,000 images (2.9%) |
| 31 | (31) | (b) | (c) | 12 | B | No fusion was observed. | 12,000 images (1.8%) |
| 32 | (32) | (b) | (c) | 13 | C | Fusion was very slightly observed. | 12,000 images (2.7%) |
| 33 | (33) | (b) | (c) | 13 | C | Toner fused to both end portions of roller. | 8,000 images (3.0%) |

TABLE 15

| Comparative example | Coating fluid No. for forming surface layer | Specific structure present in molecule A | Specific structure present in molecule B | Storage modulus of surface layer E' (MPa) | Image evaluation: Evaluation for bleeding | Image evaluation: External appearance | Image evaluation: Number of output E-letter images when reduction ratio of reflectance exceeded 3% |
|---|---|---|---|---|---|---|---|
| 1 | (34) | — | (c) | 16 | C | Remarkable fusion of toner to entire surface | 2,000 images (3.7%) |
| 2 | (35) | — | (c) | 6 | D | Toner fused to entire surface. | 5,000 images (4.3%) |
| 3 | (36) | (a) | — | 16 | D | Remarkable fusion of toner to entire surface resulting from bleeding | 1,000 images (5.8%) |
| 4 | (37) | (b) | — | 13 | D | Toner fused to entire surface. | 5,000 images (4.8%) |
| 5 | (38) | (a) | — | 20 | C | Remarkable fusion of toner to entire surface | 2,000 images (6.2%) |
| 6 | (39) | (b) | — | 18 | C | Remarkable fusion of toner to entire surface | 3,000 images (5.1%) |
| 7 | (40) | (a) | (c) | 22 | B | Remarkable fusion of toner to entire surface | 3,000 images (3.7%) |
| 8 | (41) | (a) | (c) | 4 | D | Toner fused to both end portions of roller. | 9,000 images (3.9%) |
| 9 | (42) | (b) | (c) | 22 | B | Remarkable fusion of toner to entire surface | 3,000 images (3.2%) |
| 10 | (43) | (b) | (c) | 4 | D | Fusion was very slightly observed. | 12,000 images (2.9%) |
| 11 | (44) | (a) | — | 8 | D | Remarkable fusion of toner to entire surface resulting from bleeding | 1,000 images (8.9%) |

This application claims priority of Japanese Patent Application No. 2010-292809 filed on Dec. 28, 2010 the contents of which are hereby incorporated by reference.

What is claimed is:

1. A developing roller comprising:

a mandrel;

an elastic layer provided on an outer periphery of the mandrel; and a surface layer provided on an outer periphery of the elastic layer, wherein:

the surface layer comprises carbon black, and a polyester-polyurethane resin, and wherein the polyester-polyurethane resin comprises the following structures A and B;

A: a structure represented by the following chemical formula (b); and

B: at least one structure selected from the group consisting of structures represented by the following chemical formulae (c) to (g):

(b)

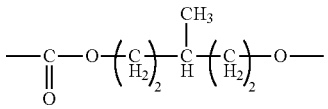

(c)

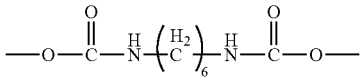

-continued (d)

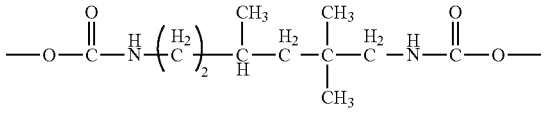

(e)

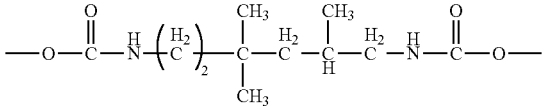

(f)

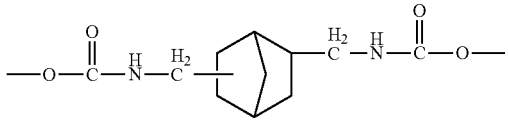

(g)

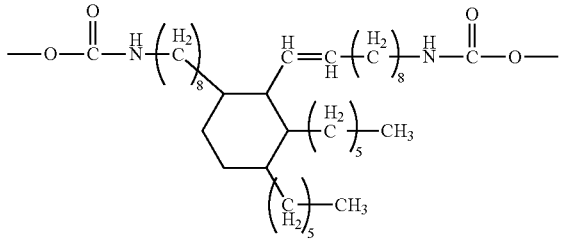

and the surface layer has a storage modulus E' of 5 MPa or more and 20 MPa or less, the storage modulus being measured at a temperature of 0° C. and a frequency of 10 Hz.

2. A developing roller according to claim 1, wherein:

the structure B comprises a structure represented by the chemical formulae (c).

3. A developing roller according to claim 1, wherein:

the structure B comprises at least one structure selected from the group consisting of the structures represented by the chemical formulae (d), (e), (f) and (g).

4. A developing roller according to claim 1, wherein said polyester-polyurethane resin is formed by reacting polyester polyol containing the structure represented by the chemical formula (b) and isocyanate compound.

5. A developing roller according to claim 4, wherein said polyester polyol is one obtained from 3-caprolacton of 3-methyl-1,5-pentandiol as a raw material.

6. A developing roller according to claim 4, wherein said polyester polyol has a number-average molecular weight of from 500 to 4000.

7. A developing roller according to claim 6, wherein said polyester polyol has a number-average molecular weight of from 1000 to 3000.

8. A developing roller according to claim 4, wherein said isocyanate compound is prepolymer-type isocyanate compound derived from an isocyanate compound selected from the group consisting of TM-HDI, NBDI and DDI.

9. A developing roller according to claim 8, wherein said prepolymer-type isocyanate compound has a number average molecular weight of from 6000 to 12000.

10. A developing roller according to claim 1, wherein said elastic layer comprises a silicone rubber.

11. A process cartridge comprising:

a developing roller;

a toner-regulating member; and a toner container, and being so constituted as to be detachably mountable to the main body of an electrophotographic apparatus, wherein the developing roller comprises the developing roller according to claim 1.

12. An electrophotographic image-forming apparatus, comprising:

an electrophotographic photosensitive member; and a developing roller placed to abut the electrophotographic photosensitive member, wherein the developing roller comprises the developing roller according to claim 1.

* * * * *